US006148664A

United States Patent [19]

Baird

[11] Patent Number: 6,148,664

[45] Date of Patent: Nov. 21, 2000

[54] METHOD AND APPARATUS FOR SHUTTING IN A WELL WHILE LEAVING DRILL STEM IN THE BOREHOLE

[75] Inventor: Jeffrey D. Baird, Breckenridge, Tex.

[73] Assignee: Testing Drill Collar, Ltd., Breckenridge, Tex.

[21] Appl. No.: 09/177,277

[22] Filed: Oct. 22, 1998

Related U.S. Application Data

[63] Continuation-in-part of application No. 08/850,915, May 2, 1997, Pat. No. 5,864,057.

[60] Provisional application No. 60/063,094, Oct. 24, 1997.

[51] Int. Cl.[7] ..... E21B 47/01; E21B 49/08

[52] U.S. Cl. ..... 73/152.38; 73/152.19; 166/250.01

[58] Field of Search ..... 73/152.38, 152.19; 175/77, 25; 166/250.01, 250.07

[56] References Cited

U.S. PATENT DOCUMENTS

| | | | |
|---|---|---|---|
| 2,019,176 | 10/1935 | Dodds | 175/253 |
| 2,300,823 | 11/1942 | Whitman | 175/25 |
| 2,391,869 | 1/1946 | Dodds | 175/77 |
| 2,456,331 | 12/1948 | Whitman | 175/77 |
| 2,674,439 | 4/1954 | Chambers | 175/59 |
| 3,059,695 | 10/1962 | Chambers | 166/264 |
| 3,482,628 | 12/1969 | Griffin | 166/152 |
| 3,503,445 | 3/1970 | Cochrum et al. | 166/244 |
| 3,575,238 | 4/1971 | Shillander | 166/187 |
| 3,606,924 | 9/1971 | Malone | 166/187 |
| 3,633,670 | 1/1972 | Barry et al. | 166/125 |
| 3,850,240 | 11/1974 | Conover | 166/162 |
| 3,860,066 | 1/1975 | Pearce et al. | 166/72 |
| 4,116,274 | 9/1978 | Rankin et al. | 166/250.01 |
| 4,253,676 | 3/1981 | Baker | 277/24.6 |
| 4,345,648 | 8/1982 | Kuus | 166/106 |
| 4,480,690 | 11/1984 | Vann | 166/250.07 |
| 5,050,690 | 9/1991 | Smith | 175/50 |
| 5,655,607 | 8/1997 | Mellemstrand et al. | 166/386 |

*Primary Examiner*—Hezron Williams
*Assistant Examiner*—Jay L. Politzer
*Attorney, Agent, or Firm*—Jackson Walker L.L.P.

[57] ABSTRACT

A drill stem has a testing tool and a drill bit. To drill, the drill stem is rotated and weight is applied to the bit from the surface. To test a formation, the drill stem is left in the borehole. Compressed gas purges mud from the drill stem. The testing tool has upper and lower collars. The lower collar has a valve seat therein. A valve member is dropped from the surface down inside of the drill stem to seat in the valve seat. When the valve member seats, the lower collar is unlatched from the upper collar, and a piston drives fluid into an inflatable packer to set the packer. With the well shut in, the drill stem test can be initiated. The valve member can be lowered on a wireline and can be selectively removed or placed in the valve seat, wherein alternating shut in and flow periods for the drill stem test can be conducted. In addition, the testing tool can be used in combination with a circulating sub, which circulating sub has a bypass valve that is actuated by a dead man. Together, the testing tool and the circulating sub can be used to control blow outs and thief zones.

9 Claims, 23 Drawing Sheets

METHOD AND APPARATUS FOR SHUTTING IN A WELL WHILE LEAVING DRILL STEM IN THE BOREHOLE

This application is a continuation-in-part application of Ser. No. 60/063,094, filed Oct. 24, 1997 and is also a continuation-in-part application of Ser. No. 08/850,915, filed May 2, 1997 now U.S. Pat. No. 5,864,057.

FIELD OF THE INVENTION

The present invention relates to methods and apparatuses for conducting production tests of wells penetrating earth formations, such as oil and gas wells.

BACKGROUND OF THE INVENTION

In drilling oil and gas wells, the drilling operator desires to obtain production information on the earth formation of interest. Such information includes the type and quality of fluid (whether liquids or gases) that is produced by the formation, as well as the flow rate and pressure of the fluid. Such information is useful in determining the commercial prospects of the well. A well that shows satisfactory production capability may be completed, while a well that shows no commercial promise is typically plugged and abandoned, with no further drilling expense incurred.

The desired information is typically obtained by drill stem testing. When the drilling extends the borehole into the formation of interest, a drill stem test of the formation maybe initiated. To change over from drilling to a drill stem test, the drill stem is removed from the borehole and the drill bit is taken off. The drill stem is lowered back into the borehole, with a packer and testing equipment at the lower end of the drill stem. The testing equipment is lowered to the formation of interest.

Conventional drill stem testing requires the drill stem and the drill bit to be pulled from the borehole to the surface. The borehole is then prepared for the drill stem test. Preparation includes lowering the testing equipment into the borehole, typically with the same drill stem that was used to drill the borehole.

When a well is drilled, the bit is lowered to the bottom of the borehole by a long string of drill pipe and collars. Weight is applied to the drill stem and the drill stem is rotated. This in turn rotates the drill bit, which drills the borehole deeper.

Drilling mud is circulated from the surface down inside of the drill stem. The mud exits the drill stem through jets in the drill bit. The mud then returns to the surface via the annulus, which is between the drill stem and the borehole walls.

During drilling, the mud serves several purposes. One purpose is to carry away the rock and other cuttings from the bottom of the borehole. Because the cuttings are continuously carried away, the cutting surfaces of the drill bit do not become fouled. Another purpose is to maintain static pressure on the bottom of the borehole. If the drill bit penetrates a formation with pressurized fluid, a well blowout could occur. The weight of the mud on the formation minimizes the risk of a blowout.

Unfortunately, this blowout prevention aspect of the drilling mud also serves to interfere with a drill stem test. If the formation of interest is exposed to the drilling mud, the static pressure of the mud may prevent the formation from producing during the test. As a result, the formation is isolated from the drilling mud during a drill stem test.

When the drill string is pulled from the borehole to the surface in preparation of a drill stem test, the drilling mud exits the drill pipe. The testing equipment is attached and lowered back into the borehole by the drill pipe. The testing equipment contains one or more valves. At least one of these valves is initially closed while the testing equipment is lowered into the borehole. Thus, the drilling mud is prevented from reentering the drill pipe because of the closed valve.

A packer is provided as part of the testing equipment. When the testing equipment has been lowered to the formation of interest, the packer is deployed against the borehole walls. The packer seals the annulus around the testing equipment and above the formation of interest. Thus, the formation of interest is isolated from the static pressure of the drilling mud. The drill stem test can now be conducted.

The actual drill stem test includes alternately opening and shutting the valves in the testing equipment. Opening the valves allows the formation to produce fluid up into the drill pipe. Closing the valves allows fluid pressure to build inside of the formation. Fluid pressure and flow are monitored as part of the test.

The actual drill stem test lasts only a few hours. However, the time to change over from drilling to testing and back to drilling takes much longer. In some instances, a full day of drilling can be lost due to a drill stem test. Because drilling rigs are typically leased by the day, this downtime results in greater expense in drilling a well.

SUMMARY OF THE INVENTION

It is an object of the present invention to provide a method and apparatus for conducting a drill stem test that minimizes the set up time for the test.

It is a further object of the present invention to provide a method and apparatus for conducting a drill stem test while leaving the drill bit in the borehole.

It is a further object of the present invention to provide a method and apparatus for conducting a drill stem test while maintaining control over formation fluids.

The present invention is applicable to drill stem testing, controlling a blowout, and controlling a thief zone.

The present invention provides significant advantages over the prior art. Because the testing tool is carried downhole with the drill bit, and can be used in drilling operations, the set up and knock down time for a drill stem test is greatly reduced. The drill stem need not be pulled from the borehole to set up the drill stem test. The equipment necessary for the drill stem test is already located downhole where it is needed.

In addition, the tool can be reused many times without having to bring it to the surface for resetting and reuse. The tool is easily set in place by inflating the packer. Once the packer is inflated, the borehole is packed off. From the packed off position, the tool is easily collapsed and reset for its next use. Shear pins are not used in the tool. Because the tool can remain downhole for plural drill stem tests, test time is further reduced.

The packer is inflated with clean fluid, not with drilling mud. Drilling mud has a tendency to clog valves, ports, and channels leading to the inflation chamber of packers. This reduces the reliability of the tool. Using clean fluid to inflate the packer increases the downhole reliability of the tool.

The tool is not susceptible to getting stuck in the borehole. The packer can be deflated by dropping the upper collar down over the lower collar. This is true regardless of whether the data probe becomes stuck.

The control of formation fluids reduces the danger of drilling. One problem of drilling is that as the drill stem is picked up out of the hole, the crew has no idea how high the oil is inside of the drill pipe. Consequently, as they unscrew the drill pipe, oil and gas can spill out onto the rig floor. This creates fire hazards and environmental problems. With the present invention, the drill stem is purged of all formation fluids by reverse circulation, and the formation fluids are safely routed to a holding area.

The apparatus of the present invention is for use in a borehole with a drill string having a drill pipe and a drill bit. The apparatus has an upper sleeve and a lower sleeve that are telescopically coupled together. The upper and lower sleeves are structured and arranged to be connected in line with the drill string above the drill bit. The lower sleeve is located closer to the drill bit than is the upper sleeve. The upper and lower sleeves have an interior passage therethrough, wherein mud can circulate through the drill stem. The upper and lower sleeves rotate together in unison, wherein power can be transferred to the drill bit.

A valve seat is located in the interior passage and coupled to the lower sleeve. The valve seat is structured and arranged to accept a valve member, which when seated in the valve seat, closes the interior passage. There is a fluid chamber located between the upper and lower sleeves. The fluid chamber has a lower end wall that is connected to the upper sleeve and an upper end wall that is connected to the lower sleeve. The lower end wall, the upper end wall, and the upper and lower sleeves seal the fluid chamber from the interior passage and any drilling fluids that may be contained therein. The fluid chamber has fluid therein. An inflatable packer is coupled to one of the upper or lower sleeves. The packer has a packer chamber therein which packer chamber is in communication with the fluid chamber.

In accordance with one aspect of the present invention, a releasable latch couples the lower sleeve to the upper sleeve. The lower sleeve is capable of telescoping with respect to the upper sleeve when the latch is released. The valve seat is slidable within the lower sleeve between open and closed positions. The valve seat cooperates with the latch so as to release the latch when the valve stem is in the closed position and so as to engage the latch when the valve seat is in the open position.

The valve seat includes a sleeve that is slidably located within the interior passage of the lower collar. The valve seat has a spring that cooperates with the lower collar so that the valve seat is normally in the open position. In addition, the latch comprises dogs that are coupled to the lower collar. The valve seat contacts the dogs and forced the dogs to engage a recess in the upper collar when the valve seat is in the open position. The valve seat allows the dogs to move radially and disengage the recess when the valve seat is in the closed position.

In another aspect of the present invention, the valve seat is structured and arranged to latch the valve member when the valve member seats in the valve seat. The valve seat can be structured and arranged to accept a variety of valve members. For example, the valve member can be a data probe having latches therein. In addition, the valve member could be a dead man or simply a ball.

In another aspect of the present invention, the upper and lower sleeves are coupled together by longitudinal splines. The splines allow the upper and lower sleeves to rotate in unison as well as allow the upper and lower sleeves to telescope with respect to each other.

In another aspect of the present invention, there is a dump chamber located between the upper and lower sleeves. The dump chamber communicates with the fluid chamber by a relief passage that has a one-way valve therein. The one-way valve is oriented so as to allow fluid to flow from the dump chamber to the fluid chamber. The packer chamber communicates with the dump chamber by way of a bypass valve that has an actuator. The actuator is operated by a stop surface located on one of the upper and lower sleeves when the upper sleeve is rotated.

In accordance with another aspect of the present invention, the upper sleeve has a bearing surface that contacts a bearing surface on the lower sleeve when the upper and lower sleeves are telescoped together. Thus, weight can be applied from the surface to the bit through the apparatus for drilling purposes.

In accordance with another aspect of the present invention, the packer has spring straps that extend from a first end of the packer to a second end of the packer. The straps assist in preventing overinflation of the packer as well as assist in deflating the packer.

In accordance with another aspect of the present invention, the packer is contained within a sheath that is coupled to the other of the upper or lower sleeves. The sheath provides protection around the packer. The fluid chamber is filled with a liquid and a gas so that the packer can exit from the sheath before being inflated.

In accordance with another aspect of the present invention, the valve member includes one or more sensors as well as a sample chamber.

There is also a method of conducting a drill stem test in a borehole, with the drill stem having a drill bit. The method drills with the drill stem in the borehole by rotating the drill stem, applying weight to the drill stem from the surface and pumping mud through the drill stem. Rotation of the drill stem is ceased. The drill stem is then purged of mud. A valve member is lowered from the surface inside of the drill stem, allowing the drill member to latch and seat in a valve seat so as to close off the drill stem. In addition, the valve member is allowed to unlatch a piston in a fluid reservoir that is isolated from drilling fluids in the borehole. The piston is forced to compress the fluid reservoir and inflate a packer with the fluid from the fluid reservoir.

In accordance with one aspect of the present invention of the method, the valve is formed by the valve member and the valve seat so as to allow a formation to produce into the drill stem, while maintaining the packer in an inflated condition. In another aspect of the invention, the step of opening the valve formed by the valve member and the valve seat also include opening a passage through the valve member. This allows pressure to equalize across the valve.

In accordance with another aspect of the invention, the step of opening a passage through the valve member also includes manipulating the valve member by a wireline so as to open the passage.

In accordance with another aspect of the invention, the valve member is provided with instrumentation. The step of dropping the valve member from the surface inside of the drill stem also includes dropping the valve member on a wireline. After latching the valve member to the valve seat, the wireline is manipulated to unlatch the valve member from the valve seat and retrieving the valve member to the surface, while maintaining the packer in the inflated condition.

In accordance with another aspect of the invention, the drill stem is rotated to open a bypass valve and allow the fluid from the inflated packer to flow to a dump chamber, wherein the packer deflates.

In accordance with another aspect of the present invention, the drill stem is reset by putting weight on the bit after the packer is deflated and forcing the fluid in the dump chamber into the fluid chamber. Drilling is resumed with the drill stem in the borehole.

BRIEF DESCRIPTION OF THE DRAWINGS

FIG. 13 shows drilling operations with the testing tool in place in the borehole.

FIG. 14 shows purging mud from the inside of the drill stem in preparation for a drill stem test.

FIG. 15 shows dropping the data probe in preparation of setting the testing tool.

FIG. 16 shows shutting in the formation by inflation of the packer.

FIG. 17 shows the formation producing up into the drill stem.

FIG. 18 shows deflating the packer.

FIG. 19A is the upper portion of the tool, FIG. 19B is the intermediate portion, and FIG. 19C is the lower portion.

FIG. 22A shows the top of the tool; FIG. 22B shows a portion of the tool located below the portion shown in FIG. 22A; FIG. 22C shows a portion of the tool located below the portion shown in FIG. 22B; FIG. 22D shows a portion of the tool located below the portion shown in FIG. 22C; FIG. 22E shows a portion of the tool located below the portion shown in FIG. 22D.

DESCRIPTION OF THE PREFERRED EMBODIMENT

Figure 1:
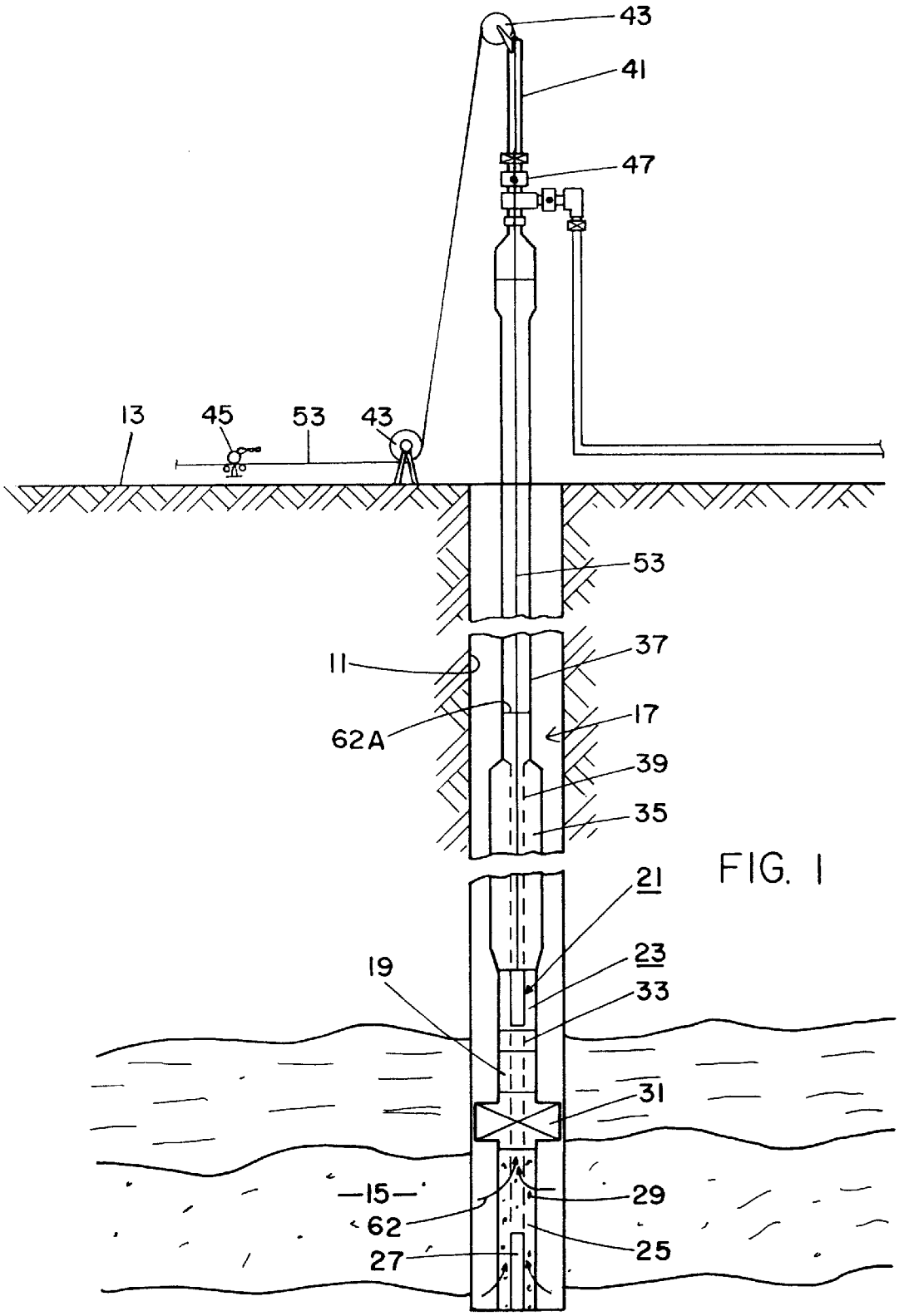
FIG. 1 is schematic longitudinal cross-sectional view of a well containing equipment for conducting a drill stem test, which equipment includes the apparatus of the present invention.

The present invention utilizes a probe during a drill stem test. The probe is lowered inside of the drill stem by way of a wireline from the surface to seat in a nipple. The nipple is in the drill stem near the formation of interest. When the probe seats in the nipple, the formation becomes shut-in. The probe can be released from the nipple to allow the formation to produce fluid up into the drill stem. Once released, the probe can be retrieved to the surface.

Thus, the probe acts as a valve inside of the drill stem. The probe can be used with a conventional drill stem testing tool, which tool requires the removable of the drill bit from the borehole, or the probe can be used with an unconventional testing tool that is lowered into the borehole with the drill bit.

The probe 21 and a conventional testing tool 19 are described below with reference to FIGS. 1–12. The drill stem above the conventional testing tool 19 has been modified with the provision of a nipple 23. The nipple 23 receives the probe 21.

The use of the probe 21 with an unconventional testing tool 201 is described below with reference to FIGS. 13–24. In addition to the probe, other valves can be used with the testing tool of FIGS. 13–24. One embodiment of the testing tool 201 is shown in FIGS. 13–21. Another embodiment of the testing tool 401 is shown in FIGS. 22A–24.

The unconventional testing tool 201, 401 can be used in a drill stem test, to prevent blow outs and to control thief zones. The data probe 21 is preferably used to conduct a drill stem test. The data probe can also be used in conjunction with the testing tool 201, 401 to control blow outs and thief zones.

Figure 26:
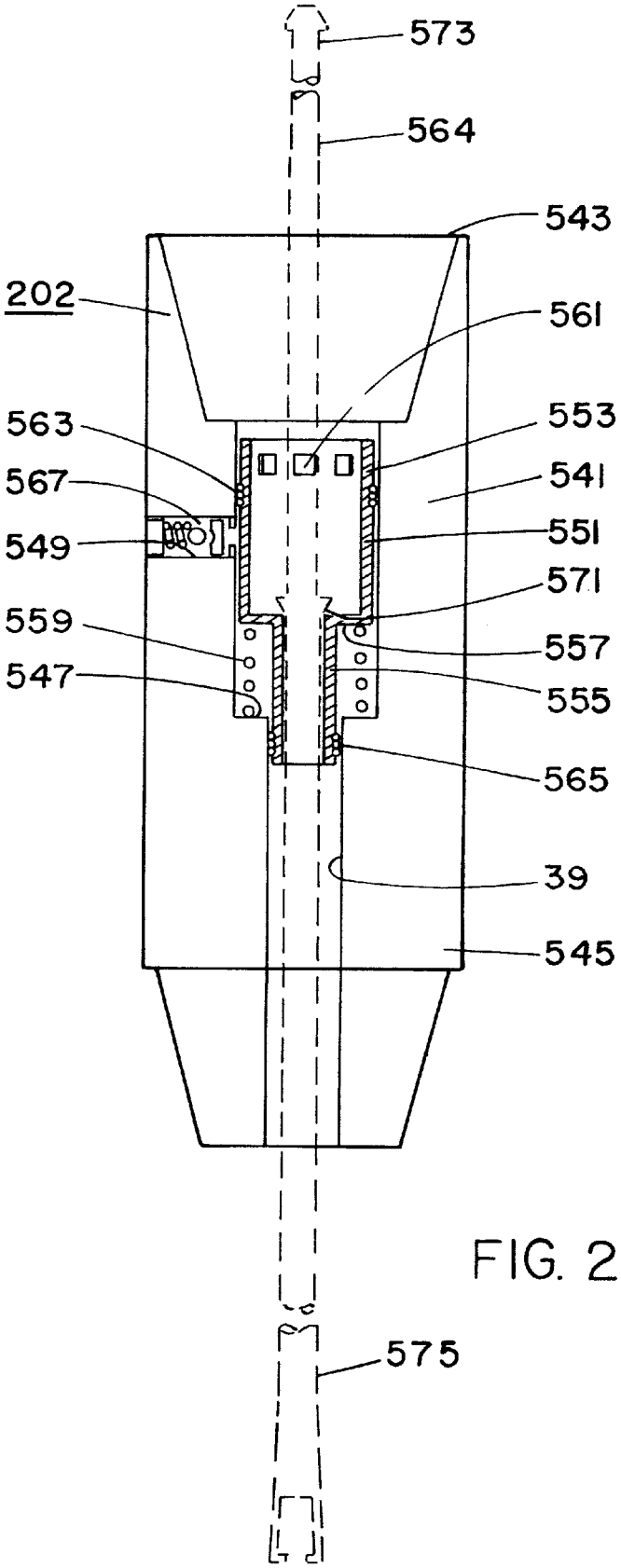
FIG. 26 is a longitudinal cross-sectional view of a circulating sub used with the present invention.

In controlling blow outs and thief zones, the data probe and the testing tool 201, 401 are used in conjunction with the circulating sub 202, shown in FIG. 26.

Figure 25:
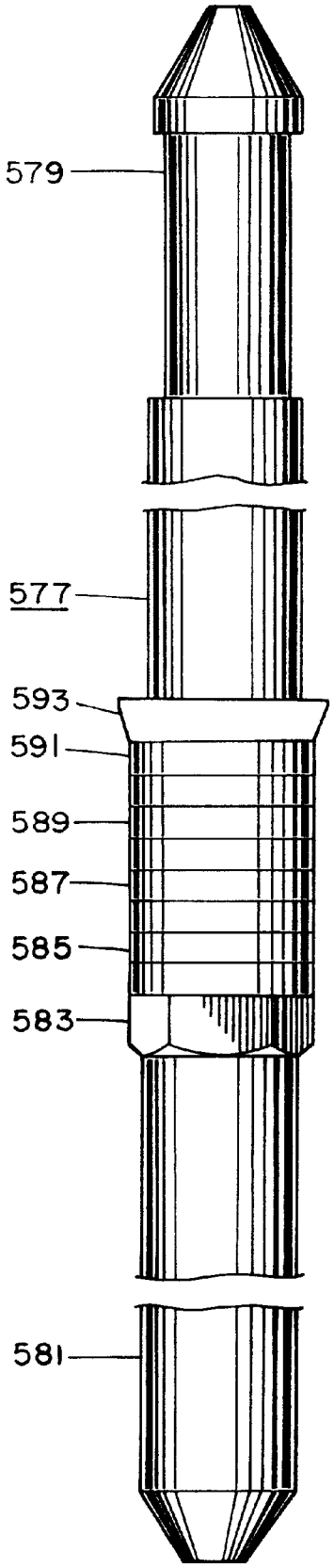
FIG. 25 is a view of a dead man used with the present invention.

In lieu of the data probe, a dead man, shown in FIG. 25, can be used in conjunction with the testing tool 201, 401 and the circulating sub to control blow outs and thief zones.

FIGS. 1–12 will now be described in detail.

In FIG. 1, there is shown a cross-sectional view of an oil or gas well. The well has a borehole 11 that extends from the surface 13 to an earth formation 15. The formation is of interest for its potential oil or gas production capability.

In order to determine the production capability of the formation 15, a drill stem test is conducted. The test uses a drill stem 17 that extends from the surface 13 inside of the borehole 11 to the formation 15. Located in the borehole 11 is a test tool 19. The test tool 19 remains in the borehole for the duration of the test.

In a conventional drill stem test, a pressure recorder 27 is located in the drill stem. The pressure recorder typically records formation pressure on a chart. The pressure recorder 27 is seated inside of an anchor 25 below a packer 31 and therefore remains downhole for the duration of the test. (Another pressure recorder is typically provided in a bomb carrier above the packer. This recorder also remains downhole for the duration of the test.) The drill stem test includes several shut-in and flow periods. In order to retrieve the pressure recorder, the entire drill stem 17 must be pulled to the surface 13.

The present invention uses a data probe 21 that traverses up and down inside of the drill stem 17. The data probe seats inside of a nipple 23 that is located above the formation 15. By seating the data probe 21 inside of the nipple 23, the well becomes shut-in. The data probe 21 contains instrumentation (such as a pressure recorder) as well as a sampling chamber. When the time arrives to open the well for a flow period, the data probe is released from the nipple 23. This opens the drill stem to fluid (liquid or gas) flow from the formation and also allows the data probe to be retrieved to the surface. The drill stem test continues unhindered while the data probe is retrieved and its recorded information and fluid sample are analyzed. If the well is producing salt water, or has other indications of unproductiveness (such as depleted pressures), then the drill stem test can be halted at that time. This saves time and thereby reduces the expenses of drilling. If the well shows promise, then the drill stem test can be continued, using either the data probe to shut-in the well for the second and subsequent shut-in periods, or using the conventional downhole four phase tool which is in the test tool 19.

To conduct a drill stem test, the well is readied by lowering a length of drill stem 17 therein. At the bottom end of the drill stem 17 is an anchor 25. The anchor 25 is an extra heavy pipe that is perforated 29 to allow fluid from the formation to enter the drill stream. The perforations 29 are small enough to prevent large cuttings from entering the drill string. Inside of the anchor 25 is the pressure recorder 27 for recording various parameters such as pressure and temperature. Located above the anchor is the packer 31. Located above the packer is a safety joint (not shown) and the test tool 19. The test tool 19 has a four phase tool and a hydraulic tool therein. The anchor 25, the pressure recorder 27, the packer 31, and the test tool 19 are all conventional and commercially available. Located above the test tool 19 is a bomb chamber or carrier, the nipple 23, drill collars 35, and drill pipe 37. The drill pipe 37 extends all the way to the surface 13. The drill stem includes all of these components 25, 31, 19, 33, 23, 35, and 37. An interior passage 39 is provided inside of the drill stem 17, and extends from the surface 13 down into the anchor 25, where the passage communicates with the perforations 29.

There is provided surface equipment, which includes a derrick (not shown), a lubricator 41, wire line equipment, such as sheaves 43 and a drum (not shown), and a wire line measuring device 45. The lubricator 41 is located at the top of the drill pipe 37. A valve 47 is provided between the lubricator 41 and the drill stem 17. The interior of the lubricator 41 communicates with the passage 39.

The data probe 21 is lowered and raised within the drill stem 17 by a wireline 53. The wireline 53 can be either a slickline (mechanical cable) or an electrical line (with a mechanical cable and electrical conductors). If an electrical wireline is used, then data can be sent from the data probe up to the surface over the electrical line. If an electrical wireline is used, the data probe can be left downhole for the duration of the test. The data probe is manipulated to alternatively open and shut-in the well, in a manner to be described hereinafter.

The specifics of the data probe 21 and the nipple 23 will now be discussed. As used herein, the terms "upper", "lower", "above", and "below" refer to the orientation of the equipment in a vertical borehole and shown in the drawings. The equipment can be used in a horizontal borehole. The probe can be pumped into place in the nipple.

Figure 2:
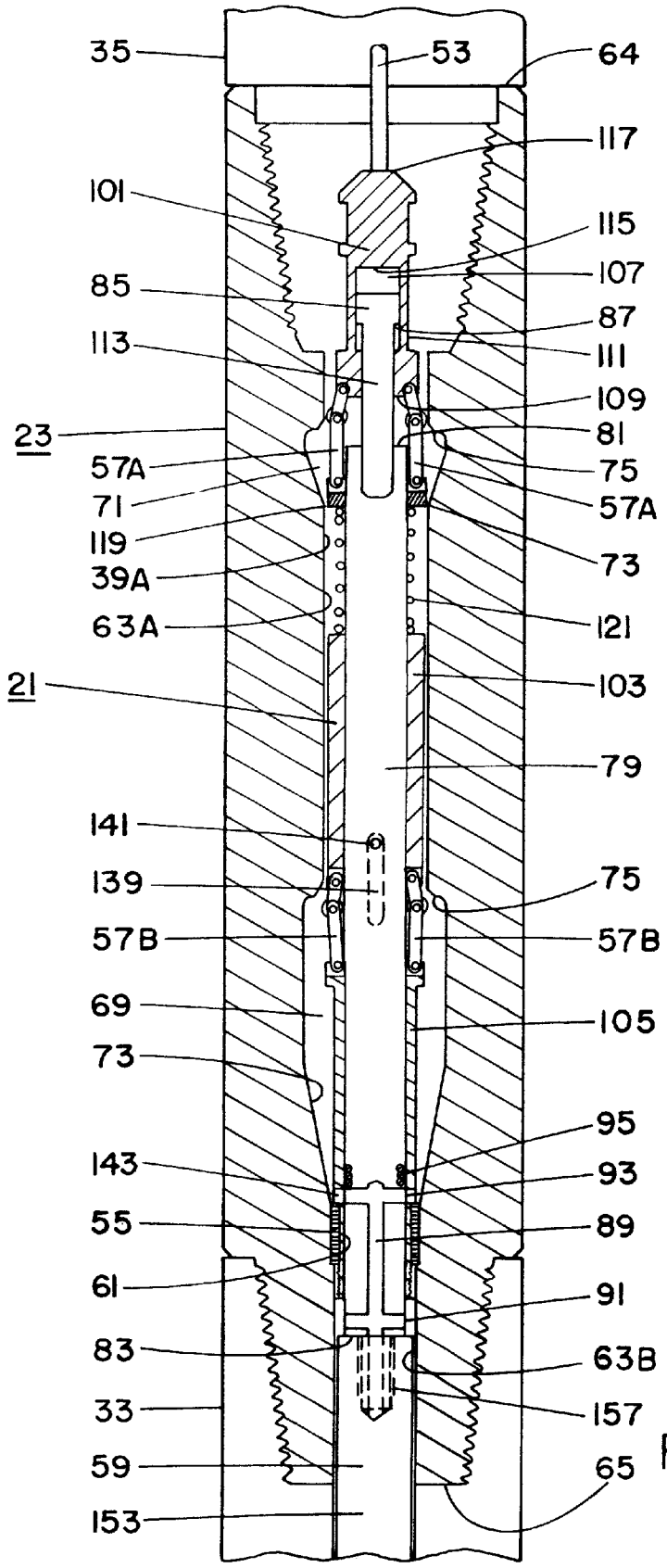
FIG. 2 is a longitudinal cross-sectional view of the nipple and data probe of the present invention, in accordance with a preferred embodiment. The data probe is shown seated in the nipple, with its latches unlatched.

As shown in FIG. 2, the data probe 21 includes packing 55, latches 57A, 57B, and an instrumentation carrier 59.

Figure 5:
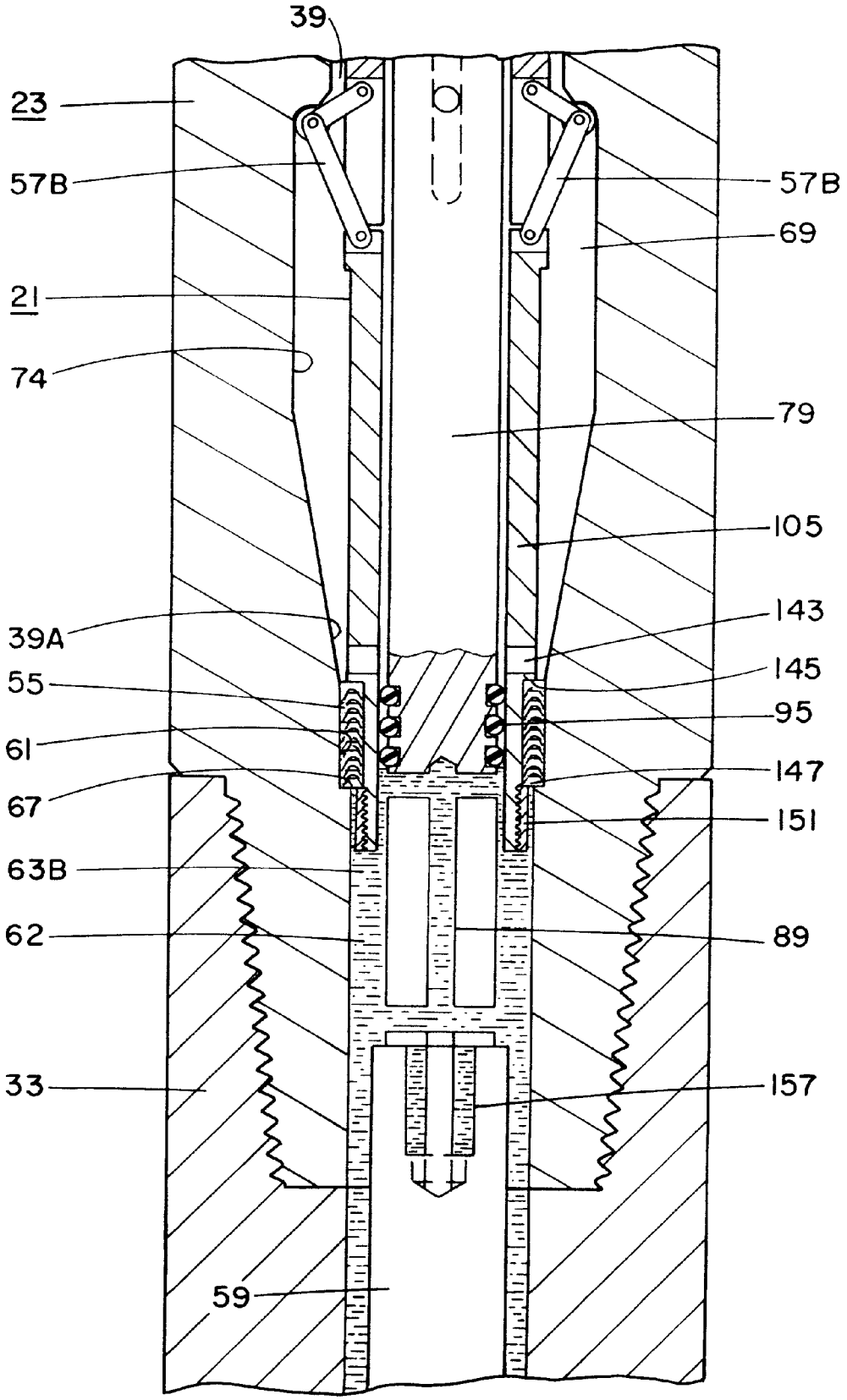
FIG. 5 is longitudinal cross-sectional close up view of the bottom portion of the data probe as seated in the nipple in the shut-in position.

Referring to FIG. 5, the packing 55 of the data probe 21 engages a packing seat 61 on the nipple 23 to seal off the passage 39 inside of the drill stem. Once a seal is made between the data probe 21 and the nipple 23, fluid cannot be produced up past the nipple. (Referring to FIG. 1, the annulus around the drill stem 17 is sealed off by the packer 31. The packing 55 (see FIG. 5) seals the inside of the drill stem 17.) The latches 57A, 57B of the data probe engage the nipple 23 so as to maintain the data probe in place inside of the nipple, even under pressure. Once the packing 55 forms a seal with the nipple 23, the fluid from the formation will exert pressure on the bottom of the data probe. The latches 57A, 57B resist this fluid pressure to maintain the seal.

The instrumentation carrier 59 is located beneath the packing 55 so as to be exposed to the formation fluid 62. The instrumentation carrier 59 contains instrumentation (such as a pressure recorder and/or a temperature recorder) and a fluid sample chamber.

Figure 3:
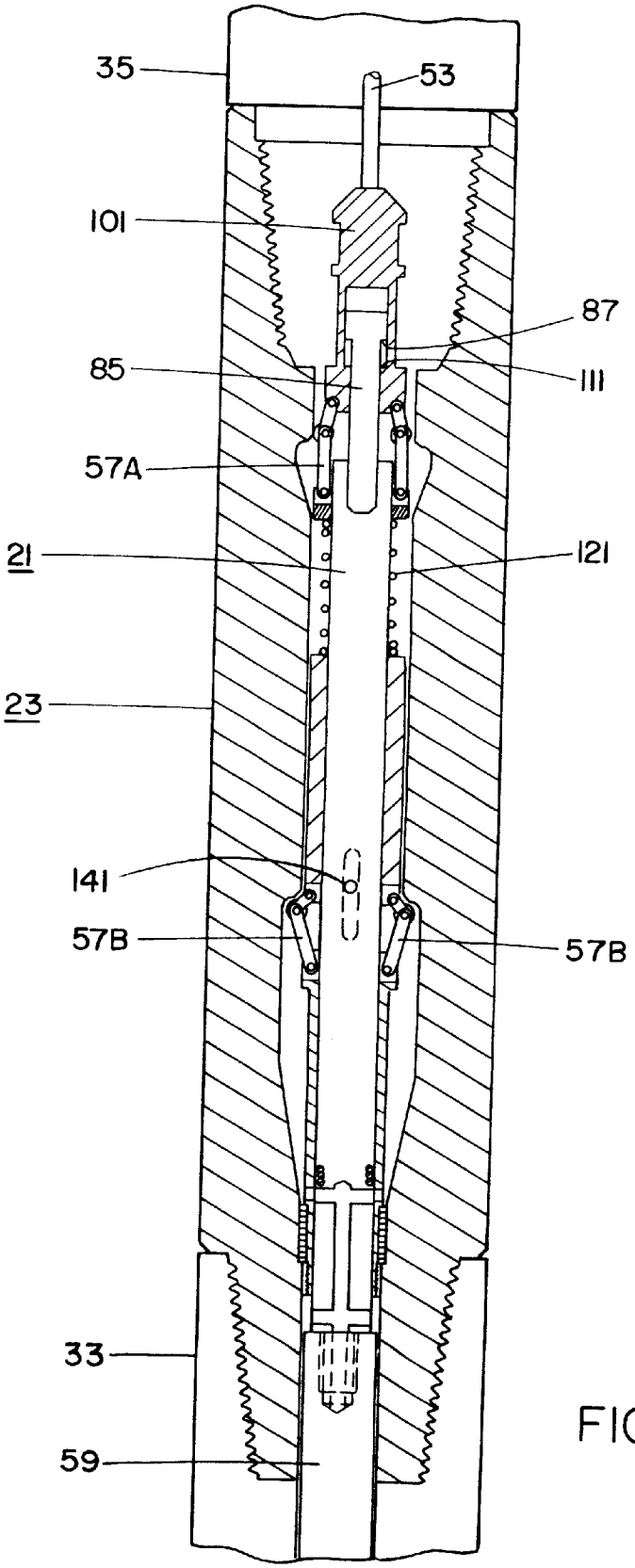
FIG. 3 is longitudinal cross-sectional view of the nipple and data probe of FIG. 2, shown with the data probe partially set or latched.

The nipple 23 will now be described in more detail, followed by a more detailed description of the data probe 21. Referring to FIGS. 2 and 3, the nipple 23 has an interior passage 39A located therein. The interior passage 39A forms a part of the overall interior passage 39 (see FIG. 1) of the drill stem 17. The interior passage 39A includes an upper portion 63A, the packing seat 61, and a lower portion 63B. The nipple 23 has a top end 64 and a bottom end 65, which are threaded so as to couple to other elements of the drill stem. The top end 64 is coupled to a drill collar 35, while the bottom end 65 is coupled to the chamber 33. Located near the bottom end 65, in the interior passage 39A, is the packing seat 61. The packing seat 61 is a polished cylindrical surface. Below the packing seat 61 is a shoulder 67 (see FIG. 5) that projects inwardly and that merges with the lower portion 63B of the interior passage 39A. The inside diameter of the packing seat 61 is larger than the inside diameter of the lower portion 63B of the interior passage 39A. The inside diameter of the packing seat 61 is smaller than the inside diameter of the upper portion 63A of the interior passage 39A.

Figure 7:
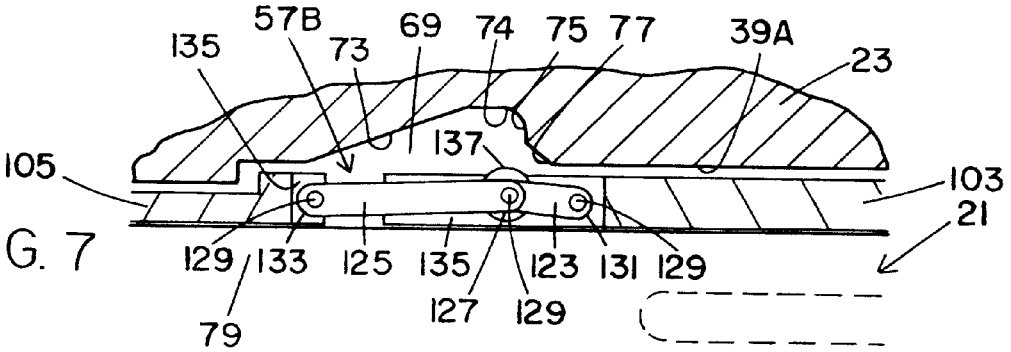
FIGS. 7–11 show close up views of a latch in various positions relative to the nipple during the deployment and release of the latch.

Located above the packing seat 61 in the interior passage 39A is a lower latch groove 69. Located above the lower latch groove 69 is an upper latch groove 71. Each groove 69, 71 represents an increase in the diameter of the interior passage 39A of the nipple 23. The grooves 69, 71 receive the latches 57A, 57B of the data probe. Each groove extends around the entire circumference of the interior passage 39A. The grooves 69, 71 are substantially similar to each other. The description that follows is applicable to both the lower and the upper grooves 69, 71. Referring to FIG. 7, which shows a close up cross-section of the lower groove 69 the lower end of each groove has a frusto-conical surface 73. The upper end of the frusto-conical surface merges with a cylindrical surface 74, which in turn merges with a shoulder 75. The shoulder 75 is located in the upper end of each groove and merges with a chamfered or bevelled surface 77, which chamfered surface merges with the cylindrical surface forming the interior passage 39A. (Two variations in the lower groove are shown in FIGS. 5 and 7. In FIG. 5, the cylindrical surface 74 is longer than the cylindrical surface 74 in FIG. 7. Thus, the lower groove can be made longer or shorter.) The shoulder 75 in each groove is oriented 90 degrees to the longitudinal axis of the nipple.

For machining purposes, the nipple 23 may be divided by a transverse joint in the middle, so as to allow boring of the grooves 69, 71.

The specifics of the data probe will now be described with reference to FIG. 2. The data probe 21 has a traveling shaft 79. The traveling shaft 79 forms a mandrel for the latches 57A, 57B and the packing 55 of the data probe. In addition, the traveling shaft provides a bypass 89 around the packing 55. The traveling shaft also provides a mount for the instrumentation carrier 59.

The traveling shaft 79 has an upper end 81 and a lower end 83. Attached to the upper end 81 of the traveling shaft 79 is a head bolt 85. The upper end of the bolt 85 has a flange 87. The head bolt 85 extends longitudinally from the upper end 81 of the traveling shaft. The instrumentation carrier 59 is attached to the lower end 83 of the traveling shaft 79. The traveling shaft 79 has a bypass passageway 89 near its lower end 83. The bypass 89 has lower ports 91 and upper ports 93. Located above the upper ports 93 are circumferential grooves, which receive o-rings 95.

The latch mechanism of the data probe will be described next. The latch mechanism actuates the latches 57A, 57B and includes a wireline retrieval head 101, upper and lower toggle latches 57A, 57B and upper and lower skirts 103, 105.

The wireline retrieval head 101 is located at the upper end 81 of the traveling shaft 79. The wireline retrieval head 101 has a bore 107 that opens at the lower end 109 of the head 101. Near the bore opening 109 is a shoulder 111 that cooperates with the flange 87 of the head bolt 85. Thus, the wireline retrieval head 101 can move longitudinally along the shank 113 of the head bolt 85. However, movement of the retrieval head 101 is limited in the up direction by the flange 87 and the shoulder 111, while movement of the retrieval head 101 is limited in the down direction by the end 115 of the bore 107 abutting the bolt 85. The upper end 117 of the wireline retrieval head 101 is coupled to an end of the wireline 53. If additional weight is required, then sinker bars can be coupled to the wireline retrieval head 101.

Located around the traveling shaft 79 are a ring 119, the upper skirt 103, and the lower skirt 105. Each of the ring 119 and the upper and lower skirts 103, 105 is cylindrical. The ring 119 is located near the upper end 81 of the traveling shaft 79. The upper toggle latches 57A are coupled to the wireline retrieval head 101 and the ring 119. The ring 119 is threadingly coupled to the traveling shaft 79 so as to move in unison therewith. Located below the ring is a helical coil spring 121, followed by the upper skirt 103. The lower skirt 105 is located below the upper skirt 103. The lower toggle latches 57B are coupled to the upper and lower skirt 103, 105. The upper and lower skirts 103, 105, and the spring 121 can slide up and down along the traveling shaft 79.

The upper and lower toggle latches 57A, 57B move between two positions, namely the stowed position and the deployed position. The toggle latches 57A, 57B are shown in the stowed position in FIG. 2. In the stowed position, the toggle latches 57 are pulled in close to the traveling shaft 79. With the toggle latches in the stowed position, the data probe 21 can move up and down inside of the drill stem 17. The toggle latches 57A, 57B are shown in the deployed position in FIG. 4. The deployed position is used to lock the data probe 21 in place relative to the nipple 23.

The latches 57A, 57B are substantially similar to each other. Referring to FIG. 7 each latch 57A, 57B includes an upper linkage bar 123 and a lower linkage bar 125. (FIG. 7 illustrates only the lower toggle latch 57B.) One end of the upper linkage bar 123 is pivotally coupled to one end of the lower linkage bar 125, so as to form an elbow 127. The other end 131 of the upper linkage bar 123 is pivotally coupled to either the upper skirt 103 or the wireline retrieval head 101. Specifically, in each upper toggle latch 57A, the other end 131 of the upper linkage bar 123 is pivotally coupled to the lower end of the wireline retrieval head 101 (see FIG. 2). In each lower toggle latch 57B, the other end 131 of the upper linkage bar 123 is pivotally coupled to the lower end of the upper skirt 103 (see FIG. 7). Likewise, the other end 133 of the lower linkage bar 125 is pivotally coupled to either the ring 119 or the lower skirt 105. Specifically, in the upper toggle latch 57A, the other end 133 of each of the lower linkage bars 125 is pivotally coupled the ring 119 (see FIG. 2). In the lower toggle latch 57B, the other end 133 of each of the lower linkage bars 125 is pivotally coupled to the upper end of the lower skirt 105 (see FIG. 7). Notches 135 for receiving the respective ends of the linkage bars 123, 125 are formed in the lower end of the wireline retrieving head 101, the upper end of the ring 119, the lower end of the upper skirt 103, and the upper end of the lower skirt 105. The pivotal coupling can be accomplished by way of pins 129.

In the preferred embodiment, the elbow of each latch 57A, 57B has a roller 137 thereon. The latches need not be provided with rollers. However, the roller eases the deployment of the latch into and out of the respective groove. The roller 137 is interposed between the two linkage bars 123, 125.

In the preferred embodiment, there are two upper toggle latches 57A and two lower toggle latches 57B (see FIG. 2). The two upper toggle latches are spaced 180 degrees apart from each other. The two lower toggle latches are also spaced 180 degrees apart from each other. Each set of upper and lower latches can include less than or more than two latches.

Figure 10:
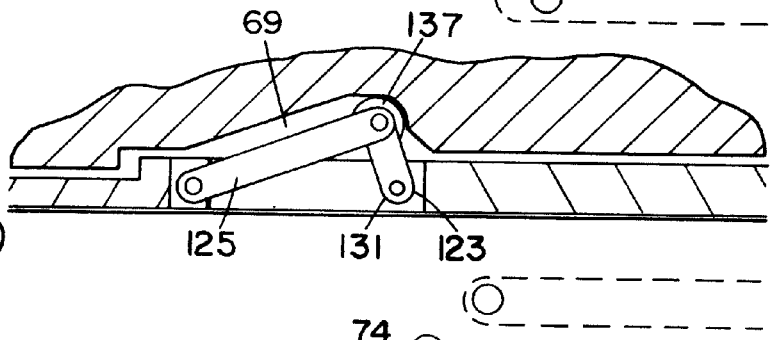

Each linkage bar 123, 125 has a longitudinal axis that extends between its pivot points. The angle between the longitudinal axes of the upper and lower linkage bars varies in accordance with position of the latch. Referring to FIG. 7, when the latch in the stowed position, the angle between the upper and lower linkage bars 123, 125 is slightly less than 180 degrees (for example, 168–175 degrees). The latch is thus bowed slightly outward towards the nipple 23. This slight bowing insures that the latch does not jam upon deployment. Referring to FIG. 10, when the latch is in the deployed position, the angle between the upper and lower linkage bars 123, 125 is about 86–91 degrees (in the preferred embodiment, the angle is about 89 degrees).

Referring to FIG. 2, the spring 121 between the ring 119 and the upper skirt 103 serves to act as a shock absorber while transferring forces between the latches 57A, 57B. The respective ends of the spring are coupled to the ring and the upper skirt.

The upper skirt 103 is provided with a longitudinal slot 139 (shown in dashed lines in the cross-sectional views) along a portion of its length. The slot is located between the latches 57B. The slot 139 receives a shear pin 141, which pin is coupled to the traveling shaft 79. The pin 141 allows limited longitudinal movement between the traveling shaft 79 and the upper skirt 103.

The lower end portion of the lower skirt 105 has ports 143 therein. These ports are arranged so as to be selectively aligned with the upper bypass ports 93 of the traveling shaft 79. The ports are located above the packing 55 of the data probe 21.

The packing 55 of the data probe will now be described with reference to FIG. 5. The packing 55 is located around the lower end of the lower skirt 105. The lower skirt 105 has a shoulder 145 that is located below the bypass ports 143. The packing 55 abuts against this shoulder 145. A packing gland 147 is below the packing 55. The packing gland 147 forms a shoulder 149 that seats onto the packing seat 61. A packing nut 151 is threaded onto the lower end of the lower skirt 105. The packing nut 151, in accordance with conventional practice, secures the packing 55 and the packing gland 147 onto the lower skirt.

Figure 4:
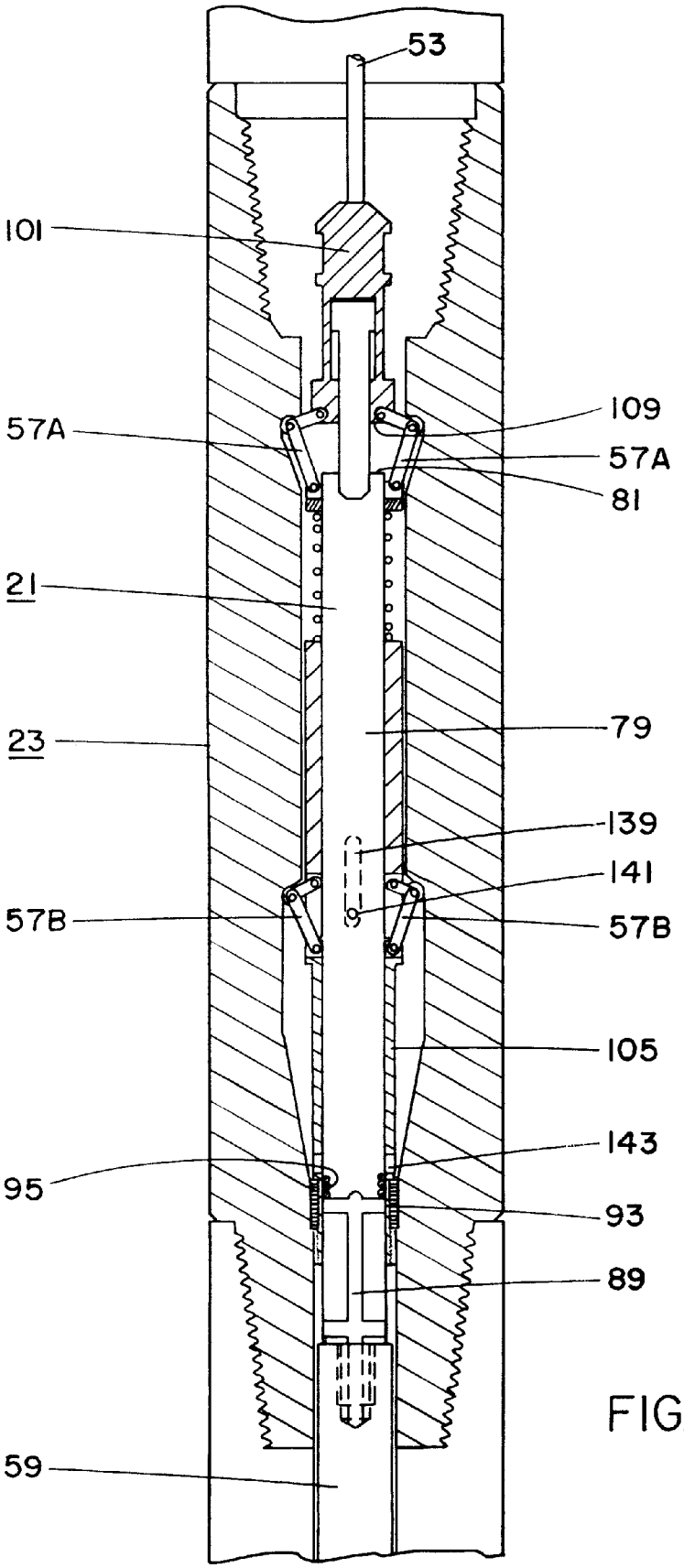
FIG. 4 is longitudinal cross-sectional view of the nipple and data probe of FIG. 2, with the data probe shown in the shut-in position.

The instrumentation carrier 59 is cylindrical. In FIGS. 2–4, only the upper end of the instrumentation carrier is shown. The upper end of the instrumentation carrier 79 threads onto the lower end of the traveling shaft 79. Thus, the instrumentation carrier 59 moves in unison with the remainder of the data probe as it moves up and down the drill stem. The instrumentation carrier has recorders located therein. There is a pressure recorder 153 and, if desired, a temperature recorder. The pressure recorder 153 has a pressure sensor that is exposed to the fluid in the drill stem. The recorded information can be accessed when the data probe is retrieved to the surface. Alternatively, a transmitter and an electronic wireline can be provided, wherein the information is telemetered to the surface while the instrumentation carrier stays down hole. Although pressure and temperature sensors have been described herein, other sensors can be utilized. The instrumentation carrier 59 also has a fluid reservoir 157 for retrieving a sample.

The operation of the data probe 21 will now be described. Referring to FIG. 1, the drill stem 17, with the nipple 23, is installed into the borehole 11 in accordance with conventional practice. The four phase tool is lowered in the open position, while the hydraulic tool is lowered in the closed position. Then, weight is applied to the drill stem 17 to set the packers 31 to isolate the formation from the drilling fluid.

The application of weight to the drill stem 17 also results in the opening of the hydraulic tool, wherein fluid from the formation flows up into the drill stem passage 39. This is the initial flow period and generally lasts 10–30 minutes.

After the initial flow period is the initial shut-in period. Using conventional techniques, the well would be closed or shut-in by rotating the drill stem five clockwise revolutions. This would close off the four phase tool (located inside of the test tool 19), wherein fluid from the formation would cease flowing into the drill stem.

However, the present invention provides an alternate way to shut-in the well, using the data probe 21. The data probe 21 is inserted into the drill stem 17 by way of the lubricator 41. Then, the data probe is lowered by the wireline 53 into the well inside of the drill stem passage 39. The well is shut-in by seating and latching the data probe 21 inside of the nipple 23. When the data probe 21 is seated in the nipple 23, the instrumentation carrier 59 is exposed to the formation fluid 62. Therefore, while the well is shut-in, pressure, temperature, and other desired information is recorded by the instrumentation in the instrumentation carrier 59.

The specifics of seating and latching the data probe 21 into the nipple 23 will now be discussed. When the data probe 21 is lowered in the drill stem 17, the latches 57A, 57B are in the stowed position and the data probe is configured as shown in FIG. 2. With the latches in the stowed position, the data probe can be easily be run up and down inside of the drill stem passage 39.

Information on the depth and type of fluid can be obtained during the descent of the data probe 21 in the drill stem (see FIG. 1). During the initial flow period, fluid will have traveled up the drill stem to a location above the nipple 23. As the data probe drops through the upper reaches of the drill stem, its speed of the descent will be relatively fast, because the data probe is traveling through gas (such as air or natural gas). The data probe will suddenly slow down when it contacts the top 62A of the fluid column inside of the passage 39. This is evident to the wireline operator on the surface by the slackening of the wireline 53. The wireline operator can determine, from the wireline counter 45, the depth of the fluid level from the surface. This information is useful for indicating formation pressures. In addition, the operator is able to approximate the type of fluid that has been produced in the drill stem by the amount of slack produced in the wireline as the data probe initially contacts the fluid. A hard fluid, such as water, produces more slack in the wireline than a softer fluid, such as oil. Also, if the data probe drops erratically once it has encountered fluid, then the fluid is likely to contain pockets of gas.

Figure 6:
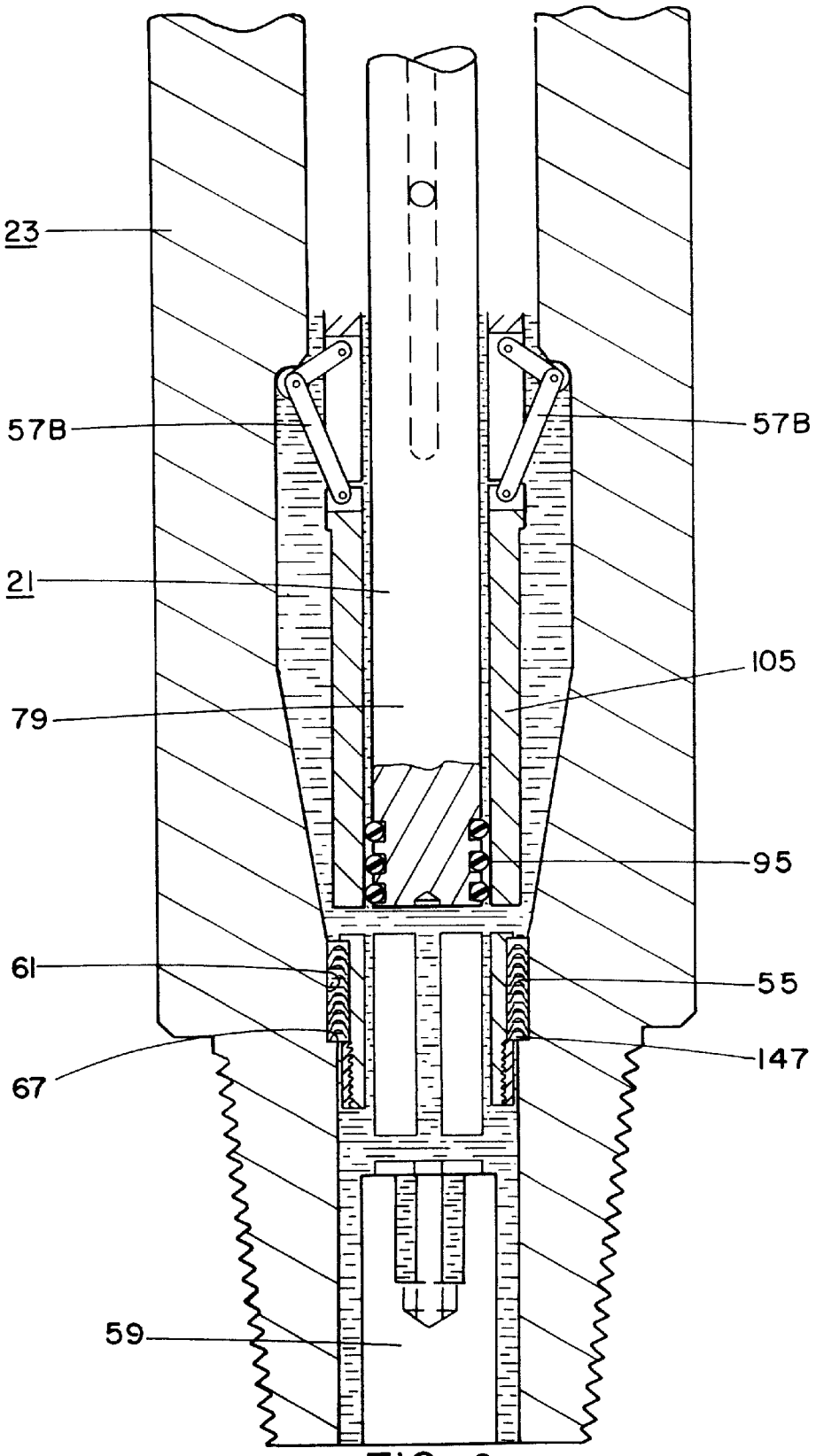
FIG. 6 is longitudinal cross-sectional close up view of the bottom portion of the data probe shown as partially set, so as to equalize pressure.

As the data probe 21 nears the nipple 23, the operator slows the speed of the descent. Referring to FIGS. 2 and 6, the data probe 21 enters the nipple 23 and the packing 55 seats in the nipple packing seat 61 and the packing gland 147 seats on the shoulder 67.

Once the packing gland 147 seats against the nipple shoulder 67, downward travel of the lower skirt 105 is almost completely halted. Therefore, the continued downward momentum of the wireline retrieval head 101 (which can be supplemented with sinker bars) pushes the upper skirt 103 down. This downward force is transmitted from the wireline retrieving head 101 to the upper skirt 103 by way of the upper toggle latches 57A (which are not yet aligned with the upper latch groove 71 and are thus prevented from deploying) and the spring 121 (which is relatively stiff). The downward movement of the upper skirt 103 relative to the lower skirt 105 causes the lower toggle latches 57B to deploy outwardly.

Figure 8:
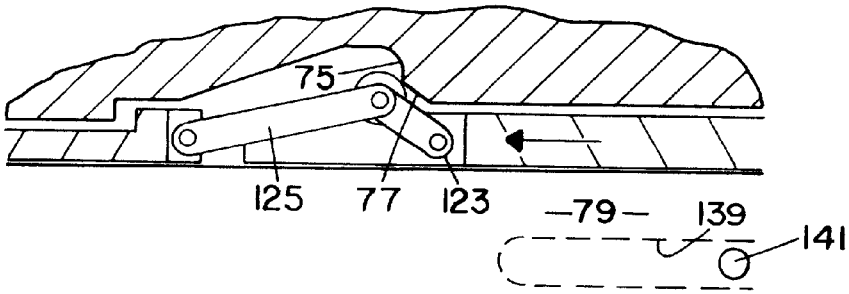
Figure 9:
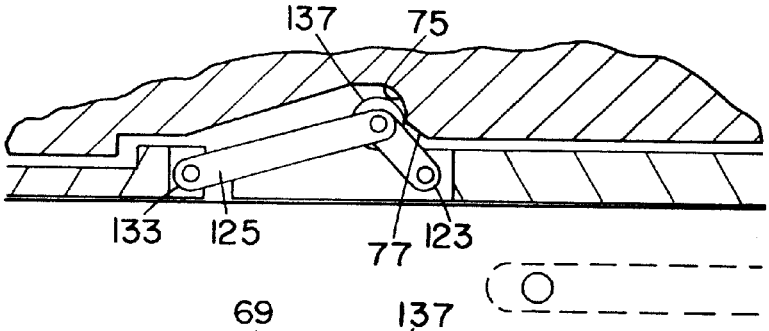

Referring to FIGS. 7–10, the deployment of the lower toggle latches 57B will be described. (In FIGS. 7–10, although only a lower toggle latch 57B is shown, the illustration is also representative of an upper toggle latch 57A) In the orientation of FIGS. 7–10, downhole is to the left, while uphole is the right. In FIG. 7, the packing has just seated in the nipple 23. This anchors the lower end 133 of the lower linkage bar 125. As downward force is exerted by the weight of the head 101 on the upper skirt 103, the upper end 131 of the upper linkage bar 123 is forced downwardly. This forces the roller 137 to deploy outwardly, away from the traveling shaft 79, as shown in FIG. 8. The roller 137 contacts the chamfered surface 77 just above the shoulder 75. Continued downward force by the head 101 against the latches compresses the packing and removes all slack (see FIG. 9). This also causes the lower end 133 of the lower linkage bar 125 to move downward slightly, wherein the roller 137 clears the chamfered surface 77 and contacts the shoulder 75. The latch becomes fully seated as shown in FIG. 10 when continued downward force by the wireline retrieval head 101 (FIG. 3) pushes the upper end 131 of the upper linkage bar 123 down, thereby forcing the roller 137 out and against the wall 74 of the groove 69. The latch 57B is now fully deployed and seated against the shoulder surface 75 of the groove 69. The data probe 21 is partially latched to the nipple 23, as shown in FIG. 3. The packing 55 is fully latched to the nipple.

Continued downward force by the head 101 closes the bypass 89 and deploys the upper latches 57A. As the wireline retrieval head 101 is forced down by its momentum, the ring 119 and the traveling shaft 79 are pushed down in unison. The upper latches 57A are prevented from deploying because they are not yet aligned with the groove 71. Consequently, the upper latches 57A push the ring 119 and traveling shaft 79 down. Downward travel of the traveling shaft 79 causes the upper ports 93 of the bypass 89 and the o-rings 95 to move down below the ports 143, as shown in FIG. 5. This shuts in the well.

The bypass 89 is retained in the closed position of FIG. 5 by the upper latches 57A. The upper toggle latches 57A are deployed in much the same way as are the lower toggle latches 57B. As the bypass 89 is closed by downward movement, the rollers 137 of the upper toggle latches 57A descend within the nipple passage 39A and become aligned with the chamfered surface of the upper groove 71. Further downward motion of the lower linkage bars, the ring 119 and the traveling shaft 119 is allowed by the spring 121. The wireline retrieval head 101 continues to exert downward force on the upper linkage bars of the upper toggle latches 57A, causing deployment of the upper toggle latches into the upper groove 71.

The data probe 21 is now latched in place inside of the nipple 23, as shown in FIG. 4. The data probe remains latched in place by maintaining the weight of the wireline retrieval head 101 on the upper toggle latches 57A.

The distance between the shoulders 75 in the two grooves 69, 71 is less than the distance between the rollers 137 of the upper and lower latches 57A, 57B, as can be seen in FIG. 2. This difference in distances provides that the upper latches deploy sequentially with respect to the lower latches. The lower latches 57B deploy first, followed by the deployment of the upper latches 57A. The upper latches are unable to be deployed until the lower latches deploy, due to the upper latches not yet being aligned with the upper groove 71.

Moving the traveling shaft 79 down to close the bypass causes the pin 141 to move down in the slot 139 (see FIG. 4). The pin 141 is coupled to the traveling shaft 79, while the slot 139 is formed in the lower skirt 105. The pin and slot arrangement is used to unlatch the lower toggle latches 57B, as will be discussed hereinafter.

At this stage, the well is completely shut-in. Fluid 62 pressure is allowed to increase for the shut-in period.

The instrumentation carrier 59 is located in the bomb chamber 33 just below the packing 55. Consequently, the carrier 59 is immersed in the fluid 62 and is subjected to formation pressures. This allows the formation fluid pressure to be recorded. Also, a portion of the fluid 62 enters the sampling chamber 157 (see FIG. 5).

Figure 11:
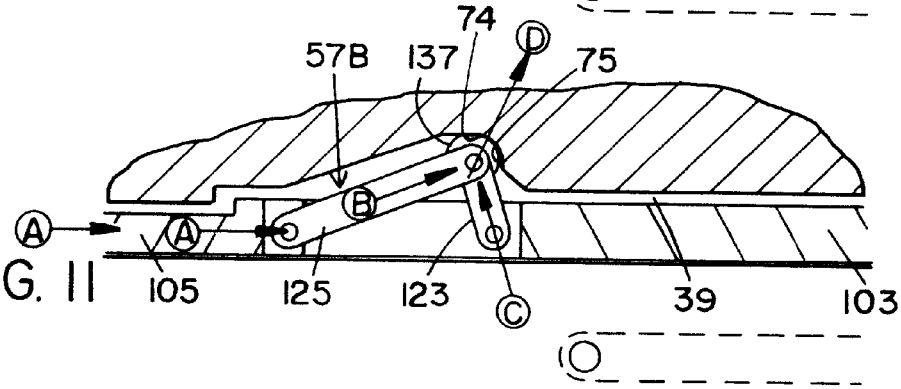

The data probe 21 is capable of withstanding large formation pressures. Referring to FIGS. 5 and 11, the pressure from the formation attempts to push the packing, the lower skirt 105 and the traveling shaft 79 up the drill stem. This fluid pressure force (shown as "A" in FIG. 11) is vectored (shown as "B") along the longitudinal axis of the lower linkage bar 125 of each of the lower toggle latches 57B. In addition, this fluid pressure force is opposed by the downward force of the wireline retention head 101 and its weight, which downward force is vectored (shown as "C") along the longitudinal axis of each of the upper linkage bars 123 of the lower toggle latches 57B. The resultant force of forces "B" and "C" is shown as "D" in FIG. 11. This resultant force "D" is directed into the corner of surfaces 74, 75 and well away from the passage 39. Consequently, the lower toggle latches 57B will not accidently slip out of the groove 69. The upper toggle latches are 57A are similarly configured in order to prevent accidental unlatching by pressure acting on the traveling shaft 79.

The shut-in period of the well is followed by either a flow period, or the end of the test. In either circumstance, the pressure on the uphole and downhole sides of the packing 55 (see FIG. 5) should be equalized before retrieving the data probe. Equalization of pressure occurs with the bypass 89. To equalize the pressure, the wireline operator picks up on the wireline 53 until the weight indicator shows some gain. Then, the wireline operator picks up on the wireline a few inches. This action lifts the wireline retrieval head 101 a few inches (see FIGS. 3 and 4). This unlatches the upper latches 57A by pulling upwardly on the upper linkage bar 123 of each latch (see FIGS. 10 and then 9). As the upper linkage bar 123 is pulled up, the roller 137 moves in towards the traveling shaft and out of the nipple groove (see FIGS. 8 and 7). The latches are now in the stowed position as shown in FIG. 7.

When the upper latches 57A become stowed, any continued upward movement by the wireline retrieval head 101 will be transmitted through the upper latches to the ring 119. Consequently, continued upward movement of the head 101 pulls up on the ring 119, thereby raising the traveling shaft 79. This opens the bypass 89 by aligning the upper ports 93 with the ports 143 of the lower skirt 105 (see FIG. 6)

Opening the bypass allows pressure across the packing 55 to equalize. Fluid flows from the downhole side of the data probe to the uphole side through the bypass 89, through the annulus between the data probe 21 and the nipple 23, and up towards the surface 13 inside of the drill stem passage 39. An immediate blow will be indicated at the surface therefore assuring successful opening of the bypass 89.

Lifting the wireline retrieval head 101 a few inches to open the bypass 89 also moves the pin 141 to the top of the slot 139. Thus, any further upward movement of the traveling shaft 79 will also raise the upper skirt 103.

After the pressure across the data probe has equalized, the wireline operator picks up the wireline 53, which raises the wireline retrieval head 101. This pulls the traveling shaft 79 up (by the upper latches 57A and the ring 119). The traveling shaft 79 pulls the upper skirt 103 up (by the pin 141 acting the upper end of the slot 139). Moving the upper skirt up unlatches the lower toggle latches 57B. The lower toggle latches are unlatched as follows (see FIGS. 7–10 in reverse order): the upper skirt 103 pulls the upper ends 131 of the upper linkage bars 123 up. This pulls the rollers 137 out of the groove 69 to unlatch the lower toggle latches 57B. The upward tension on the spring 121 before the pin 141 touches the top of the slot 139 assists in unlatching the lower latches 57B.

The pin 141 is useful in case the data probe 21 becomes stuck in the hole. Lifting with the wireline can produce sufficient force to shear the pin 141 inside of the slot. The allows the retrieval of the head 101, the upper latches 57A, the traveling shaft 79, and the instrumentation carrier 59, to the surface. In this manner the information can at least be retrieved from downhole. The skirts 103, 105, the lower latches 57B, and the packing 55 is left downhole for subsequent retrieval when the drill string is pulled from the hole.

The data probe 21 is now completely unlatched from the nipple 23. The well begins a flow period, wherein fluid from the formation flows up into the drill stem. During this flow period of the drill stem test, the data probe 21 is retrieved to the surface (the nipple 23 remains downhole with the rest of the drill stem 17). At the surface, the data probe reenters the lubricator 41 (see FIG. 1). The valve 47 below the lubricator is closed and the data probe is retrieved from the lubricator.

The pressure and other recorded information is retrieved from the instrumentation carrier 59 for analysis. In addition, the fluid sample is obtained from the instrumentation carrier 59. Based upon this recorded information and sample, the drill stem testing can either be continued or terminated. If the results from the data probe look promising, the drill stem test can be continued, wherein additional shut-in and flow periods are made. The data probe 21 can be dropped down the drill stem to seat in the nipple 23 in order to shut-in the well for the next shut-in period. Alternatively, the well can be shut-in and reopened using the conventional four phase tool in the test tool 19. Occasionally, the results from the data probe 21 show a well with high productivity, wherein further testing is deemed unnecessary. Instead of waiting for the drill stem test to run its course, the well can be completed right then. This saves time, thereby making the well more economical to drill. Sometimes, the results from the data probe 21 shows a well with little or no commercial productivity (such as salt water production). The drill stem test can be immediately terminated and the zone of interest is condemned. The decision can be made to drill deeper or to plug the well. This saves drilling costs that would ordinarily be incurred for a worthless zone or well.

The invention has so far been described in conjunction with the drilling of wells. However, the invention can also be used in producing wells. From time to time, it is desirable to test the production of a producing well. During such a production test, the well is shut-in and the formation pressure is allowed to increase. The increase in pressure provides useful information on the production capabilities of the well.

Figure 12:
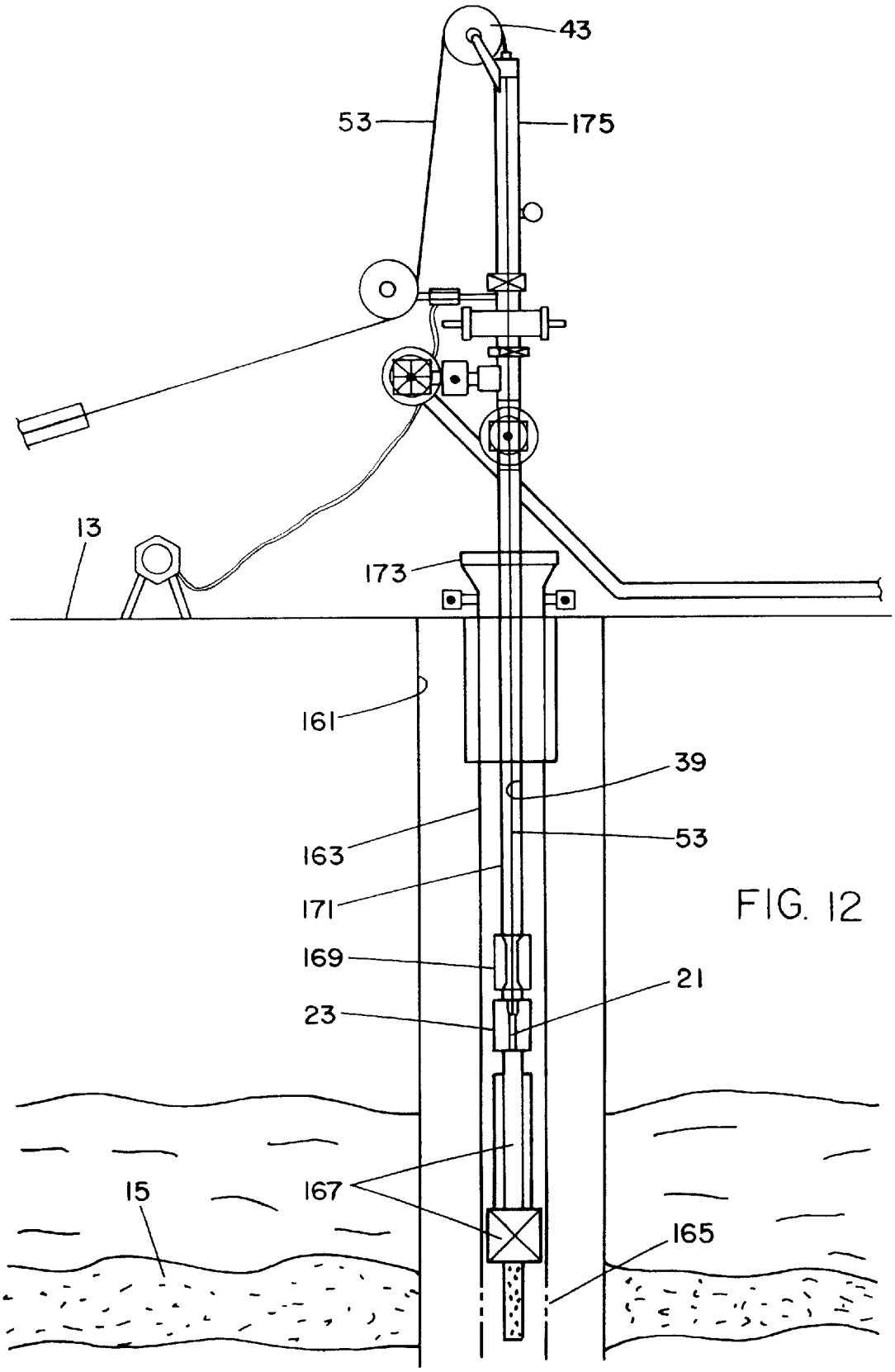
FIG. 12 is a longitudinal cross-sectional view of the present invention as used in a production well.

In FIG. 12, there is shown a view of a producing well 161. The well 161 extends in the formation of interest 15. Production equipment is in place. This equipment includes casing 163. The casing is perforated 165 at the formation 15. A packer 167 isolates the formation 15. The nipple 23 is located above the packer 167. Located above the nipple 23 is a standard seating nipple 169 found in many producing wells. A string of tubing 171 extends from the standard nipple 169 to the surface 13. A well head 173 and other equipment is also provided. The nipple 23 is installed downhole when the well is completed or when the tubing string is pulled.

During a production test, the data probe 21 is inserted into the well via a lubricator 175. A wireline 53 is used to raise and lower the data probe 21.

The data probe 21 can be used to shut-in the production well and acquire pressure data. The data probe 21 is dropped down inside the tubing on a wireline 53. It seats inside of the nipple 23, as discussed hereinbefore. Once the data probe is seated, the well is shut-in from a downhole location. Formation fluid pressure is allowed to build, which build up is recorded by the data probe instrumentation.

The well need only be shut-in for a relatively short time (for example, 24 hours) compared to conventional production well testing. Because the well is shut-in from a downhole location close to the formation, the entire column of tubing 171 need not be pressurized by the formation fluid, as with conventional testing. Therefore, use of the data probe in a production well test saves time.

After the well has been shut-in for a suitable period of time, the data probe is released from the nipple 23, as discussed hereinbefore. The data probe is then retrieved to the surface, for analysis of the data.

With the exception of the seals, which are made of rubber, the nipple and the probe are made of metal.

Figures 13, 14, 15:
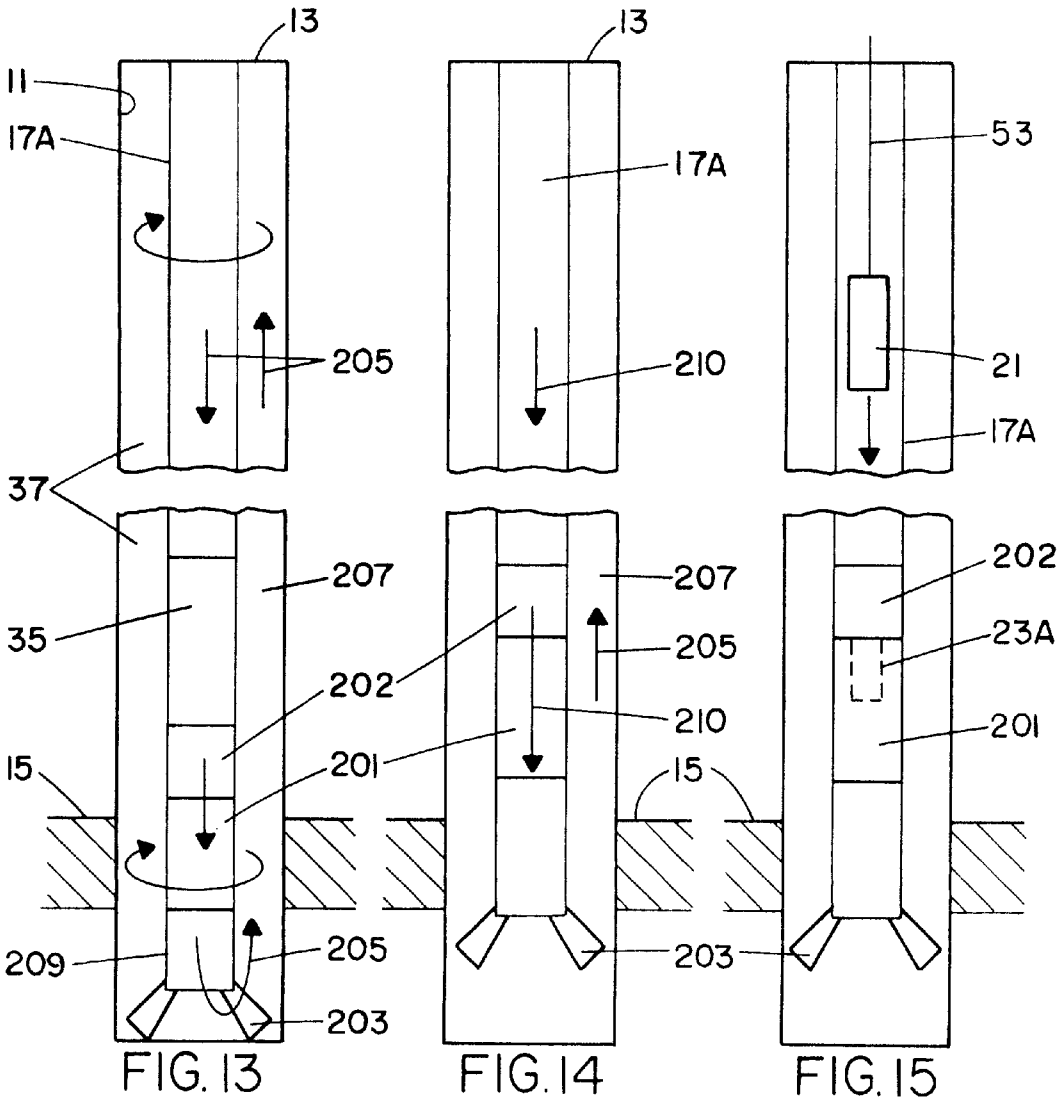
FIGS. 13–18 are schematic views of a well borehole showing the various stages in the operation of the testing tool of the present invention, in accordance with a preferred embodiment in order to conduct a drill stem test.

The testing tool 201 of FIGS. 13–22 will now be described in detail. FIGS. 13–18 show the sequence of operation. In FIG. 13, the borehole 11 is being drilled. The drill bit 203 is in place on the bottom of the borehole and the drill stem 17A is being rotated. Drilling proceeds in accordance with conventional techniques. For example, weight is applied to the drill stem at the surface 13, and drilling mud 205 is circulated down through the drill stem 17A, out through jets or orifices in the drill bit 203 and up by way of the annulus 207, where the mud returns to the surface 13.

Beginning at the bottom and working towards the surface, the drill stem or drill string 17A is made up of the drill bit 203, its associated flow sub 209, the testing tool 201, a circulating sub 202, drill collars 35, and drill pipe 37. The testing tool 201 is preferably located immediately above the drill bit 203 and its sub 209, although the testing tool can be located higher up the drill stem.

The testing tool 201 is thus part of the drill stem 17A. As the drill stem is rotated, so too is the testing tool. The testing tool 201 transmits the rotational force needed to rotate the drill bit for drilling. In addition, weight applied to the bit during drilling is also transmitted through the testing tool 201.

Figures 16, 17, 18:
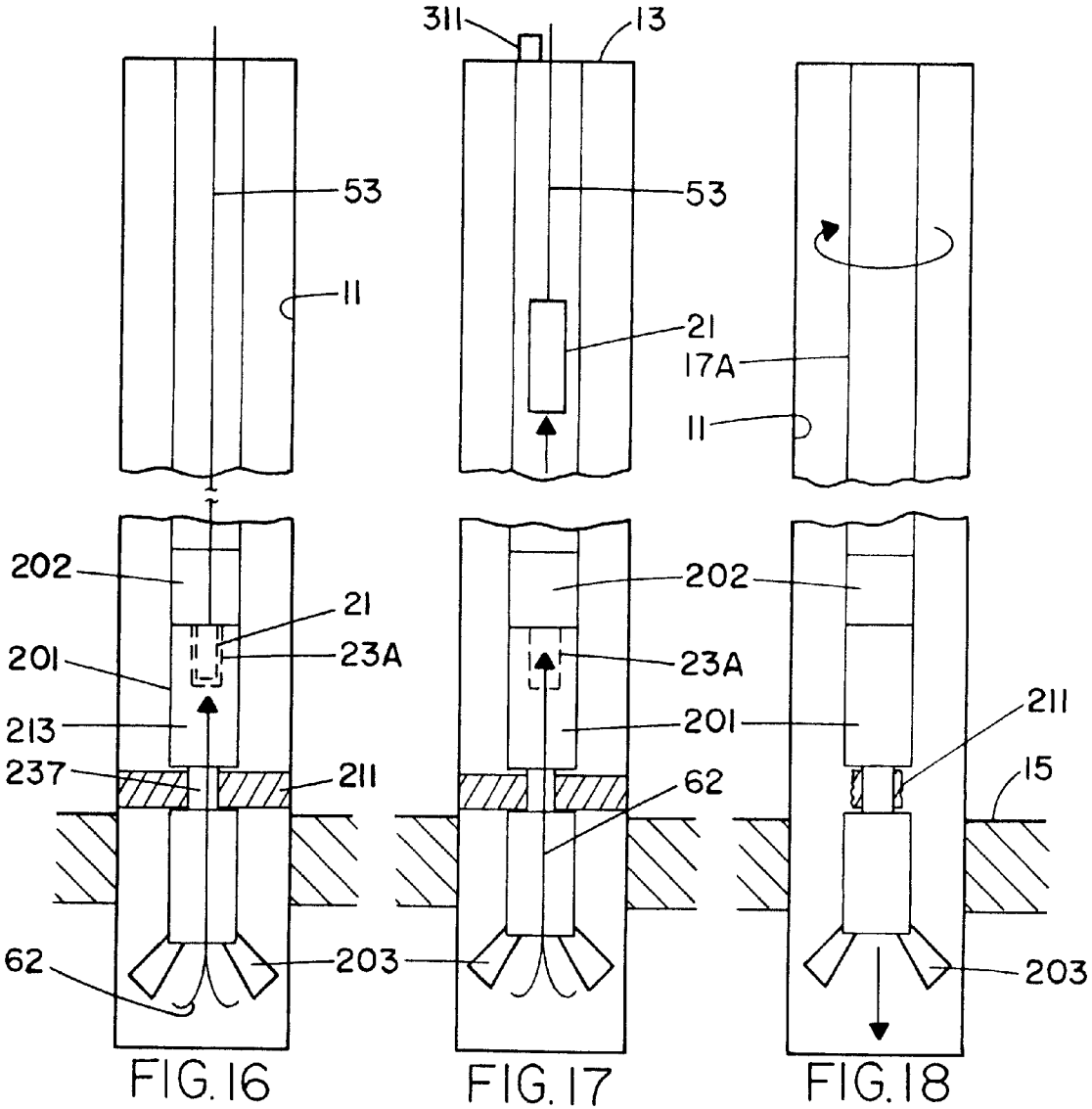

When the borehole penetrates a formation 15 of interest, the decision is made to conduct a drill stem test. In FIGS. 14–16, the borehole 11 is readied for the test. In FIG. 14, the drill stem 17A is picked up a determined distance in order to position the testing tool 201 above the formation 15 of interest. Next, because the drill stem is full of mud, the drill stem is purged by blowing in compressed gas 210 from the surface. For example, compressed nitrogen gas can be used. As the compressed gas traverses down inside of the drill stem 17A, the mud is pushed out of the bottom of the drill stem. The mud flows up to the surface via the annulus 207. In this manner, the inside of the drill pipe stem is purged of drilling mud.

With the testing tool 201 still suspended above the formation 15, as shown in FIG. 15, the testing tool is set. The testing tool is set by dropping the probe 21 on a wire line 53 down inside of the drill stem 17A. The inside of the testing tool 201 contains a nipple 23A for receiving the probe. When the probe 21 engages the nipple 23A, the nipple (which will be discussed in more detail below) slides inside of the testing tool. The inside of the drill stem 17A is now closed by the probe. The pressure exerted by the compressed gas inside of the drill stem causes a packer 211 to inflate (FIG. 16) against the walls of the borehole 11. In one embodiment, the packer is located inside of a protective sheath when uninflated. In this embodiment, the packer telescopes out of the testing tool and then inflates. In another embodiment, the packer has no sheath.

Once inflated, the packer 211 packs off the annulus 207 above the formation 15. The formation is now shut-in by the inflated bladder 211 and also by the probe-nipple arrangement 21, 23A, which forms a seal inside of the drill stem. In FIG. 16, the formation fluid 62 is shown as an arrow. The flow of fluid inside of the drill stem is stopped by the probe and nipple.

The test then enters an initial flow period. To enter the flow period, the valve inside of the testing tool is opened, namely by manipulating the probe 21. Fluid 62 from the formation flows through the testing tool up into the drill stem 17A. After initial flow and initial shut in periods, the data probe 21 is released from the nipple and retrieved to the surface 13. The probe can be used to retrieve a fluid sample as well as contain instrumentation to record pressure, temperature, and other parameters. When the probe reaches the surface, the sample and recorded information can be inspected.

The well can undergo repeated shut in and flow periods (FIGS. 16 and 17 respectively) by seating and releasing the probe 21. Some surface manipulation of pressure above the probe may be necessary to assist in seating the probe. Once inflated, the packer remains inflated, independently of the probe activity.

After the drill stem test has been completed, the testing tool 201 is reconfigured for drilling. The drill stem 17A is rotated slowly and eased to the bottom of the borehole (FIG. 18). The rotation of the drill stem opens a valve inside of the testing tool 201, thereby allowing the packer 211 to deflate. The packer 211 is then telescoped back inside of the testing tool. As the packer is deflated, the borehole undergoes reverse circulation. When the packer is released from the borehole, the annulus drilling mud will flow into the drill stem, thus displacing the formation fluids to the surface. The testing tool 201, and the remainder of the drill stem 17A, are again ready for drilling with the drill bit 203 (see FIG. 13).

The testing tool 201 will now be described in detail, with reference to FIGS. 19A, 19B, and 19C. The testing tool 201 includes an upper collar 213 and an inner assembly 215. The upper collar 213 is generally tubular, having an upper end 217 and a lower end 219. The upper collar 213 forms a housing for the inner assembly 215. The upper end 217 (FIG. 19A) is coupled to a drill collar 35. The lower end 219 (FIG. 19C) is located adjacent to the float sub 209, which float sub is in turn coupled to the drill bit 203. The lower end 219 of the upper collar is not coupled to the float sub 209, and in fact there is an opening 220 between the upper collar and the float sub. In the preferred embodiment, the upper collar 213 is fabricated from two lengths, with the joint 218 being located above the packer 211. This construction allows easy access to the bladder and its compartment in the lower section of the collar of the upper collar. However, the upper collar 213 could be fabricated from a single piece, or from multiple pieces.

The upper collar has an interior cavity 221 that extends from the upper end 217 to the lower end 219. The interior cavity 221 has a number of characteristics, which will be described beginning near the upper end 217 and proceeding toward the lower end 219. Near the upper end of the interior cavity, there is a flange 223, which flange extends radially inward. Below the flange is a circumferential groove 225. The lower lip 227 of the groove 225 is beveled. A short distance away, the interior cavity 221 widens in its inside diameter, forming a circumferential beveled shoulder 229. Extending from the shoulder 229 some distance towards the lower end, are a number of splines 231 (see FIGS. 19A and 20). The splines extend longitudinally along the inside of the upper collar 213 and project inwardly toward the longitudinal axis of the tool. In the preferred embodiment, there are four splines 231, spaced 90° apart around the circumference of the inner cavity. However, there can be more or fewer splines. The splines 231 are separated from each other by channels 232. The inside diameter (or radius) of the channels is less than the inside diameter (or radius) of the groove 225. The lower end of the splines 231 form a shoulder 233. Below the splines, the interior cavity 221 continues toward the lower end 219, wherein a flange 235 is encountered (see FIG. 19B). The flange 235, which is ring shaped, is perpendicular to the longitudinal axis of the tool and projects inwardly. Below the flange 235, the interior cavity 221 continues to the lower end 219 of the upper collar. The lower end 219 is open.

Figure 19A:
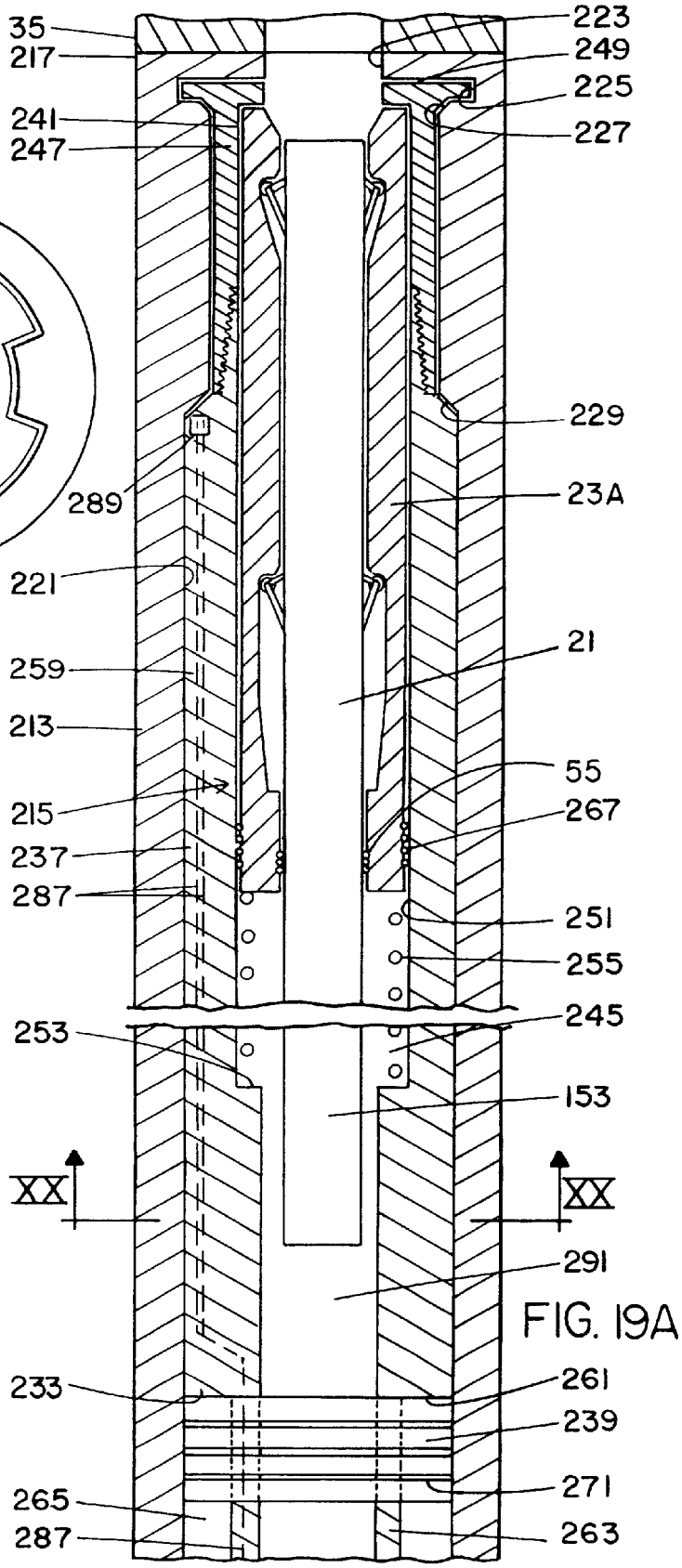
FIGS. 19A, 19B, and 19C are longitudinal cross-sectional views of the testing tool.
Figure 19B:
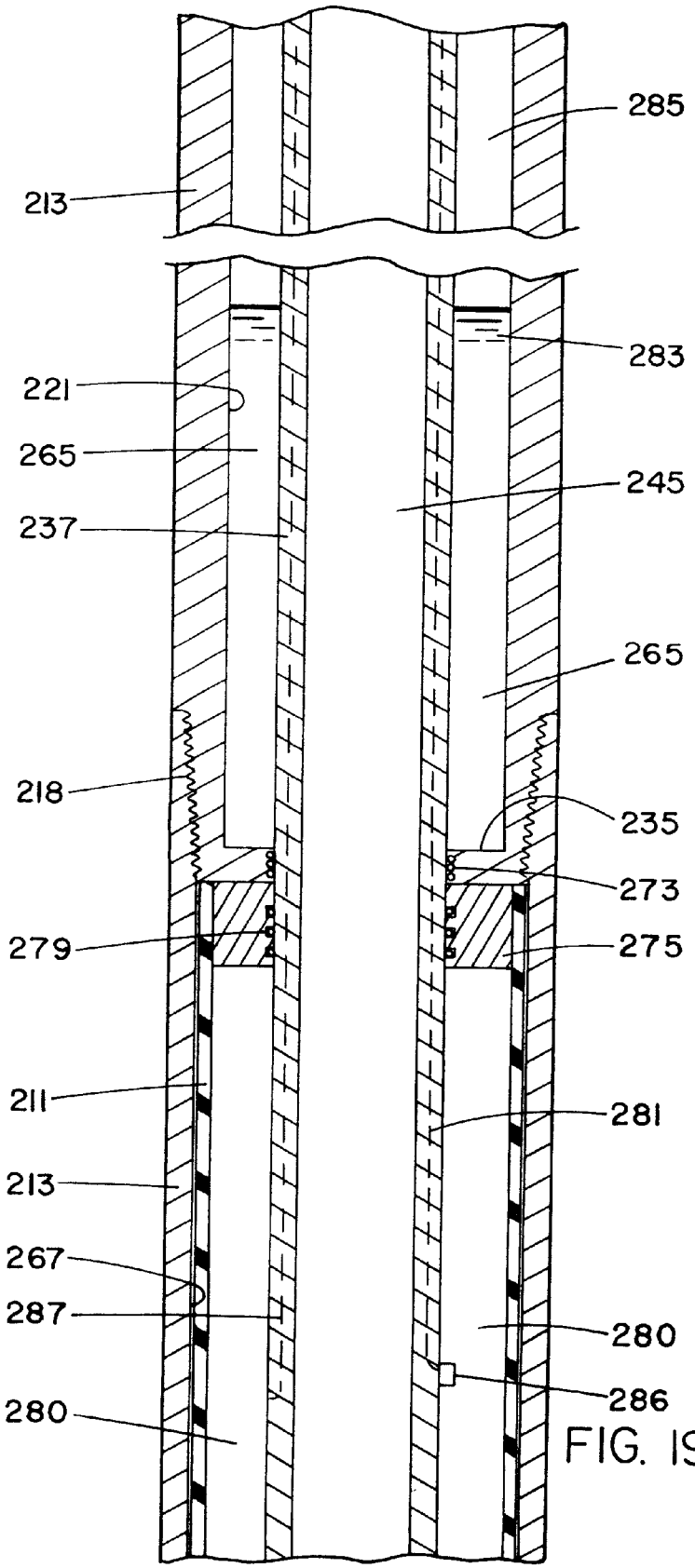
Figure 19C:
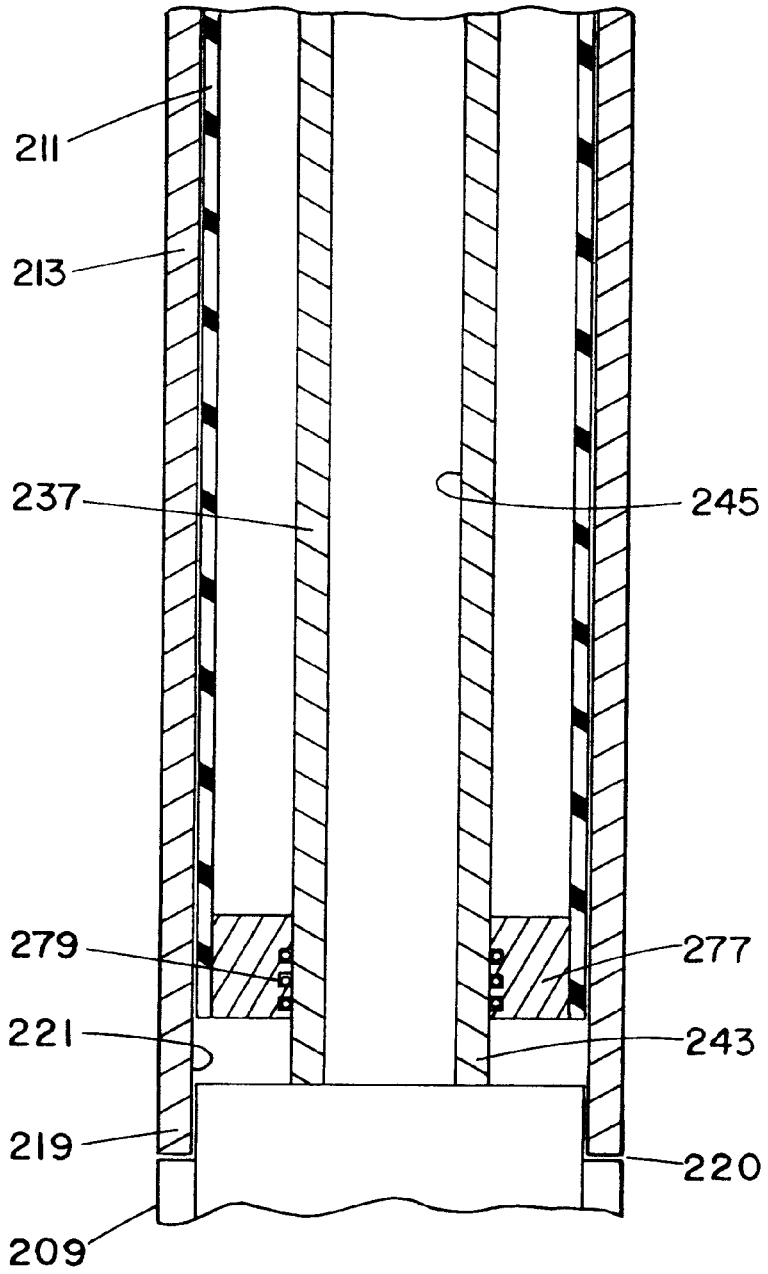

The inner assembly 215 includes a lower collar 237, a nipple 23A (FIG. 19A), a piston 239, and the packer 211 (FIGS. 19B, 19C). The inner assembly 215 is located in the interior cavity 221 of the upper collar 213.

The lower collar 237 is substantially the same (but need not be) length as the upper collar 213, and has an upper end 241 (FIG. 19A) and a lower end 243 (FIG. 19C). The lower collar 237 has an interior cavity 245 therein that extends from the upper end 241 to the lower end 243. The upper end 241 of the lower collar 237 has plural dogs 247. The upper ends of the dogs 241 are flanged 249, with the flanges extending both radially outward to engage the circumferential groove 225 and also radially inward. The flanged ends of the dogs pivot inwardly so as to disengage from the circumferential groove 225.

A chamber 251 is formed in the upper end portion of the lower collar interior cavity 245. The chamber, which extends from the flanges 249 on the dogs 247 to an upwardly facing shoulder 253 on the lower collar, contains the nipple 23A. The nipple 23A can slide up and down within the chamber 251. A helical coil spring 225 is located between the shoulder 253 and the lower end of the nipple 23A, wherein the nipple is biased against the flanges 249 of the dogs.

The nipple 23A is substantially similar to the nipple 23 described above with respect to FIG. 2. The nipple 23A has lower and upper latch grooves 69, 71. The upper and lower ends of the nipple 23A are blunt to contact the dog flanges 249 and the spring 225, respectively. In addition, the outside diameter of the lower end of the nipple has seals 267 to provide a seal between the nipple and the lower collar.

Figure 20:
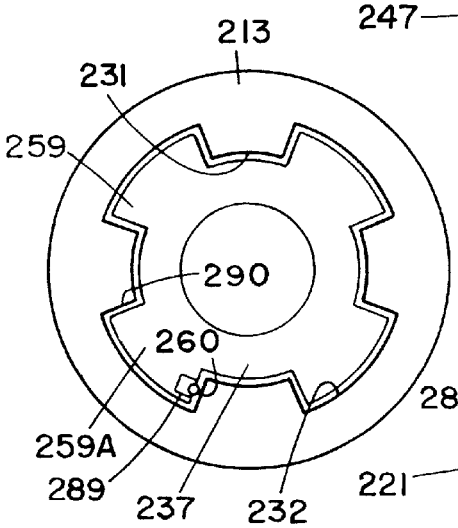
FIG. 20 is a transverse cross-sectional view of the testing tool, taken through lines XX—XX of FIG. 19A.

The outside of the lower collar 237 has splines 259 that project radially outward to cooperate with the upper collar splines (see FIG. 20). Thus, the lower collar splines 259 are received between the upper collar splines 231. The splines cause the upper and lower collars 213, 237 to rotate in unison, while allowing the lower collar 237 to slide longitudinally within the upper collar 213. The gaps between the lower and upper collar splines 259, 231 are uniform, with the exception of one gap 260. This gap 260 is wider than the other gaps so as to avoid transmitting rotational force across the gap during drilling. The gap contains a portion of a relief valve 289 which will be described below. The gap is formed by a spline 259A in the lower collar. The widened gap extends for the entire length of the spline.

Below the lower collar splines 259 is a shoulder 261 formed by a reduced wall thickness 263 of the lower collar. The lower collar, with the reduced wall thickness 263, extends from the splines 259 (FIG. 19A) to the float sub 209 (FIG. 19C). The lower end 243 of the lower collar 237 is coupled to the float sub 209.

There are two compartments 265, 267 formed in the annular region between the lower collar 237 and the upper collar 213. The uppermost compartment is a reservoir 265. The reservoir 265 is bounded at its upper end by the piston 239 and at its lower end by the plate 235, which is fixed to the outer sleeve 213. The piston 239 is connected to the lower collar 237 and slides relative to the upper collar 213. The piston 239 is ring shaped around the lower collar. The piston 239 has seals 271 around its outer diameter and also around its inner diameter.

The flange 235 (FIG. 19B) has seals 273, such as o-rings, around its inside diameter, to provide a seal against the inner collar 237. The inner collar 237 can slide through the flange.

The reservoir 265 is annular, being located between the upper and lower collars 213, 237.

The other compartment 267 is located below the flange 235. This lower compartment extends from the flange 235 to the lower end 219 of the outer sleeve 213. The lower end of the lower compartment 267 is open to the borehole (when the tool is downhole).

The packer 211 is contained in the lower compartment 267 between two heads 275, 277. There is an upper head 275 and a lower head 277. The upper head 275 is fixed to the lower collar 237, while the lower head 277 is slidably coupled to the lower collar. The heads have seals 279 around their inside diameter to seal between the heads and the lower collar. The packer 211 is connected between the upper and lower heads 275, 277. The packer is made of rubber such as a 90 durometer buna rubber that is oil resistant. The packer is a sheet that extends between the two heads. The sheet is wrapped around the outside diameter of each head and overlaps itself to form a leak-proof cylinder around an interior chamber 280. The interior chamber 280 is annular around the lower collar 237. The packer is inflatable when a fluid is injected into the interior chamber 280.

The reservoir 265 contains an oil 283 such as hydraulic fluid. The oil reservoir 265 is not completely filled with oil. A gas or vacuum pocket 285 is deliberately provided in the reservoir. As discussed below, the gas allows the packer 211 to exit the upper collar 213 before inflating.

The lower collar 237 has a first fluid passage 281 (shown by dashed lines in FIG. 19B) therein that extends from the reservoir 265 to the inside chamber 280 of the packer 211. Thus, the interior chamber 280 of the packer 211 is in fluid communication with the reservoir 265. The first fluid passage 281 serves to fill the packer 211. A one-way check valve 286 in the first fluid passage 281 prevents fluid from backing into the reservoir and thus ensures that the packer will remain inflated.

There is a second fluid passage 287 contained in the lower collar 237. The second fluid passage 287 serves to deflate the packer 211. The second fluid passage 287 extends from the interior chamber 280 of the packer 211 up to one of the splines 259 and back down to the oil reservoir 265. At the splines is a valve 289 that is normally closed. The valve 289 has a ball 290 that extends into the gap 260 between splines. When the drill stem 17A is rotated, the ball contacts the opposite spline, opening the valve.

An inside passage 291 is formed through the inside of the nipple 23A and the lower collar 237. The inside passage 291 allows for mud flow during drilling and formation fluid flow during production. The inside passage 291 is closed or sealed when the data probe 21 is seated and latched into the nipple 23A. (In FIG. 19A, the data probe 21 is shown schematically.) When the data probe is sealed and latched, the flow of formation fluid upwardly is prevented by the seals 55 on the data probe and also by the seals 273 in the flange 235. Likewise, the flow of fluid downwardly is prevented by the seals 55 on the data probe and also by the piston seals 271.

The operation of the testing tool 201 will now be described.

When the testing tool 201 is lowered downhole with the drill bit 203, it is configured as shown in FIGS. 19A, 19B, and 19C, with the exception that the data probe 21 is not located in the nipple 23A. The packer 211 is contained in the upper collar 213.

The drill bit 203 is located on the bottom of the borehole (FIG. 13) and drilling is commenced in accordance with conventional techniques. The upper collar 213 is rotated from the surface via the drill pipe 37 and the drill collars 35. The splines 231, 259 transmit the rotation from the upper collar to the lower collar in the testing tool and thus to the drill bit. Mud is circulated through the drill stem 17A, including through the inside passage 291 of the testing tool 201. In particular, the mud enters the upper end of the tool, passes through the nipple 23A, and flows through the interior cavity 245 of the lower collar 237 into the float sub 209. The mud flows through the float sub and exits via the drill bit, in order to flow back to the surface by way of the annulus.

When a formation is to be tested, drilling stops. However, circulation continues with a mud of increased viscosity in order to sweep the borehole clean. On the surface the kelly is removed and replaced with a joint of drill pipe. The drill pipe is equipped with a control head, a valve, a lubricator and test lines. The drill stem 17A is picked up a determined distance, as shown in FIG. 14. When the drill stem is picked up, both the upper and lower collars 213, 237 in the testing tool 201 are also picked up. The upper collar 213 is secured directly to the drill collar that is located immediately above, while the lower collar 237 is coupled to the upper collar by way of the dogs 247 (FIG. 19A). The testing tool 201 is lifted to a packer seat position that is located above the formation 15.

Next, the drill stem 17A is cleared of drilling mud. A floor manifold on the drilling rig is provided with a choke assembly, a nitrogen inlet and a test line inlet. Compressed gas, such as nitrogen, is injected into the drill stem though the nitrogen inlet (see FIG. 14). The gas forces the mud out through the bottom of the drill stem 17A. The mud exits the borehole at the surface through the annulus 207. The operator observes the annulus for mud flow and observes a pressure chart recorder. When the mud is cleared from the drill stem, such that gas is about to exit the drill stem at the drill bit and enter the annulus, the injection of gas stops. The amount of mud exiting the borehole can be measured to determine the level of mud inside of the drill stem to thereby prevent the amount of gas that bubbles up into the annulus. The amount of mud in the borehole and in the drill stem is typically known to the barrel.

Some mud will stick to the inside surface of the drill stem. A slug of water can be inserted on top of the mud. The mud and water are then pushed out of the drill stem by the compressed gas. The water serves to clean the mud off of the sides of the drill stem.

Also, as an alternative to measuring the amount of mud exiting the borehole, the mud level inside of the drill stem can be measured by shooting a fluid level with an echo meter. The data probe 21 is lowered on the wireline to a known depth to serve as an acoustical reflector.

After the drill stem 17A has been emptied of drilling mud, the testing tool 201 can be set in the borehole by inflating the packer 211. The formation 15 also becomes shut in.

To set the testing tool, the data probe 21 is dropped down to latch in the nipple 23A, as discussed above with respect to FIGS. 1–12. Gas pressure is maintained inside the drill stem. When the data probe 21 is latched in the nipple (see FIGS. 15, 19A), a seal is formed in the inside passage 291 of the testing tool 201. The pressure of the compressed gas inside of the drill stem is increased so as to exert downward pressure on the data probe. The data probe and the nipple are pushed down inside of the lower collar 237. The operator observes pressure readings and also travel of the wireline to determine when the tool 201 has been set. The sliding nipple 23A compresses the spring 255. In addition, the sliding nipple frees the dogs 247 by allowing their upper ends to move radially inward and out of the groove 225. With the dogs 247 free, the lower collar 237 is free to slide down relative to the upper collar 213. The upper end of lower collar is sealed by the piston seals 271. Therefore, the compressed gas pushes the lower collar down.

With the lower collar sliding down relative to the upper collar, the lower collar upper end remains inside of the upper collar. The lower collar dogs 247 move down below the shoulder 229 of the upper collar. The flanges 249 of the dogs are longitudinally aligned with the lower collar splines 259 and are therefore received between the upper collar splines 231. The inside diameter of the channels 222 between the upper collar splines 231 is less than the inside diameter of the groove 225. The dogs are thus maintained in a choked condition, thereby preventing the nipple 23A from moving up and contacting the flanges 249.

Figure 21:
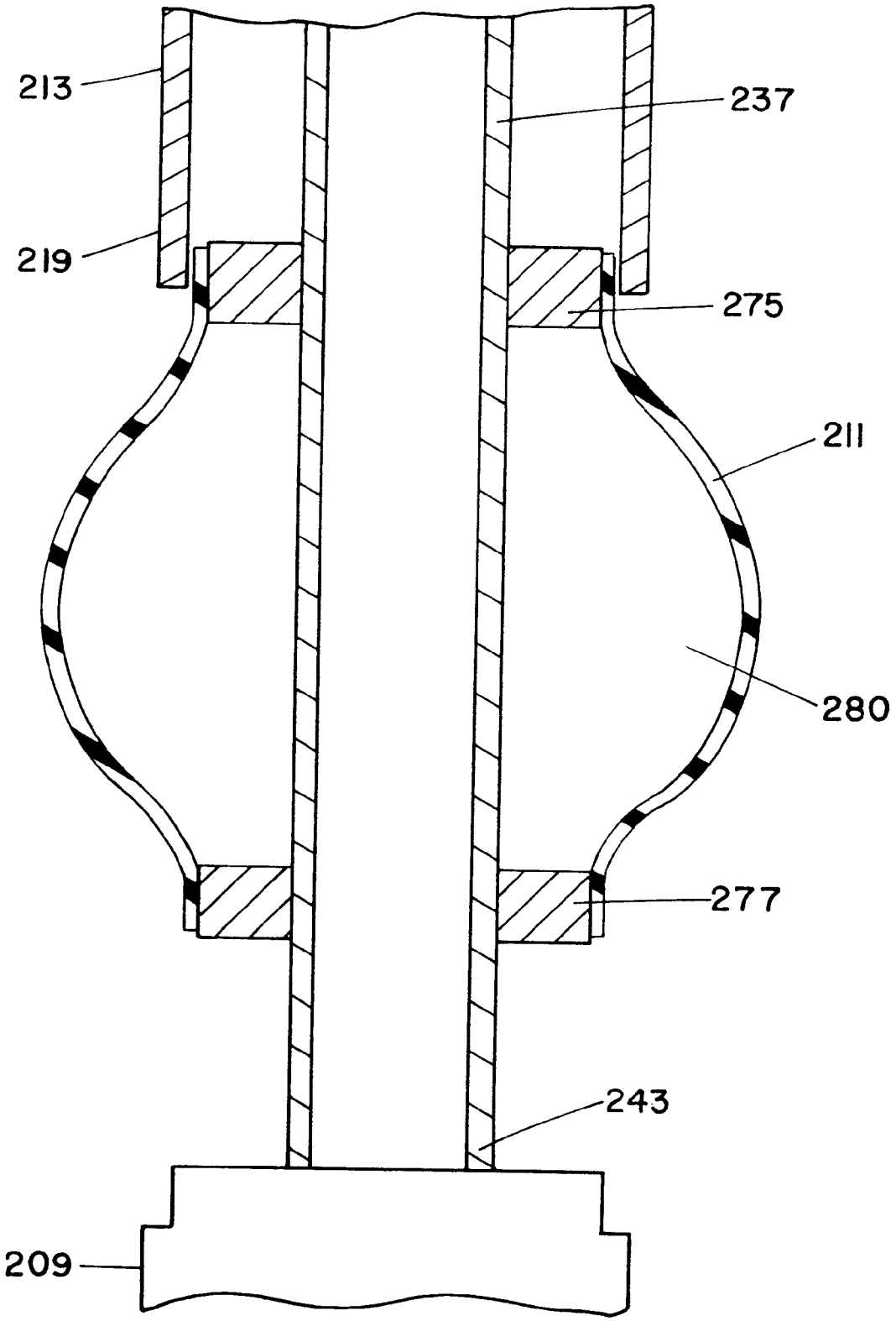
FIG. 21 is a cross-sectional view, showing the bladder in the inflated condition.

Furthermore, with the lower collar sliding down inside of the upper collar, lower end 243 of the lower collar 237 telescopes out of the lower end 219 of the upper collar (see FIG. 21). This causes the packer 211 to drop out of the upper collar, because the upper head 275 is coupled to the lower collar. In addition, the packer begins to inflate.

The packer 211 becomes inflated because the piston 239 forces oil from the reservoir 265 into the packer. As the lower collar moves down, the piston, which is coupled to the lower collar, also moves down. The oil is forced out of the reservoir 265 through the first fluid passage 281 and into the chamber 280 of the packer 211. The increased fluid in the chamber causes the packer 211 to inflate. As the packer inflates, the lower head 277 slides up the lower collar, while the upper head remains fixed to the lower collar.

The packer drops out of the upper collar 213 before inflating. This prevents the packer from inflating inside of the upper collar and becoming stuck. To minimize the possibility of becoming stuck in this manner, the reservoir 265 is provided with a quantity of gas or other compressible medium. As the piston compresses the reservoir 265, the gas is compressed. When the gas is compressed sufficiently, oil is forced into the packer for inflation. The amount of gas and oil in the reservoir and the pressure of the gas are parameters that can be adjusted to ensure that the packer exits the upper collar before inflating.

The weight of the drill bit, float sub and lower collar, together with pressure provided by the compressed gas in the drill stem and also the provision of the check valve 286, are sufficient to prevent to lower collar 237 from telescoping back into the upper collar, which telescoping would allow the bladder 211 to deflate. However, a fail safe mechanism can be provided to prevent the unintentional deflation of the packer.

The formation is now shut-in. The packer 211 provides a seal in the annulus around the drill stem, while the data probe 21 and the nipple 23A arrangement, as well as the flange 235 seals the inside of the drill stem.

Preparations are made to begin the initial flow period that is common to drill stem tests. The compressed gas in the drill stem is used to both cushion the formation against sudden pressure changes and to provide valuable information on the formation characteristics. The data probe 21 is manipulated to equalize pressure both above and below the data probe. As discussed above, the wireline 53 is picked up to open the bypass in the data probe 21. Pressure can now be equalized across the data probe.

A pressure sensor 311, such as a chart recorder, is provided at the surface (see FIG. 17). The pressure sensor senses any change of pressure inside of the drill stem. If the pressure in the drill stem increases, then the formation could be a highly productive one. In such a situation, the drill stem test can be continued. Some of the compressed gas can be bled off from the drill stem after the pressure becomes constant in order to promote production from the formation. The gas is bled off by opening the choke on the surface. If there is no significant change in pressure, then the formation may have been damaged by the drilling mud or else the formation is unproductive. In such a situation, a prolonged drill stem test may have to be made. Some or all of the nitrogen gas is bled from inside of the drill stem.

As the gas pressure drops, the operator observes the annulus to insure that the packer forms a good seal. If the mud in the annulus drops, the packer is leaking. More gas pressure can be added to increase the packer inflation.

If the pressure decreases, then the formation is likely to be depleted or unproductive. In such a situation the compressed gas can be bled off quickly and the drill stem test can be terminated.

After equalizing pressure across the data probe and observing the change in pressure, the data probe is released from the nipple, as described above. The test enters the initial flow period when pressure is equalized across the data probe. Formation fluid flows up into the drill stem 17A by way of the interior passage 291. While the well is flowing, the data probe is left in place down hole in order to allow its instruments to take measurements and to collect a fluid sample.

During the drill stem test, it may be desirable to maintain compressed gas downhole in the formation in order to provide a cushion. When the formation is allowed to produce, the gas cushion minimizes the damage to the formation. Some of the compressed gas can be bled off in order to assist in production. The gas is bled off to the atmosphere.

Equipment may have to be provided to allow the formation fluid to flow into the drill stem. If a float sub 209 is used, then the sub is modified. The sub is provided with perforations that allow communication between the annulus and the inside of the drill stem, bypassing the float sub. The perforations are located above the float sub. The perforations become exposed to the annulus when the lower collar of the testing tool telescopes out. The perforations are sealed when the lower collar telescopes back in. Alternatively, a float sub need not be used, wherein flow through the drill bit up into the drill stem is permitted.

After the initial flow period, the test can begin the initial shut-in period. In fact, the test alternates between shut-in periods and flow periods. During the second and subsequent flow periods, the data probe is released from the nipple and retrieved to the surface, where the instrumentation is examined for recorded information and the fluid sample is also examined. The formation is shut-in when the data probe is latched in the nipple. The formation can flow when the data probe is released from the nipple.

When the drill stem test is finished, the testing tool 201 is readied for either drilling or for pulling from the borehole. The testing tool is disengaged from the borehole by deflating the bladder 211. To deflate the packer, the drill stem 17A is rotated (see FIG. 18). The rotation of the drill stem 17A opens the valve 289 (FIGS. 19A and 20), wherein oil from the packer 211 exits through the second fluid passage 287 and into the reservoir 265. The oil travels through the second fluid passage 287 first in an upward direction from the packer to the valve 289, and then downward from the valve to the reservoir 265. Alternatively, a dump chamber can be provided above the piston, which dump chamber receives the oil from the second passage. A one-way valve connects the dump chamber to the reservoir 265 so as to allow oil to flow from the dump chamber to the reservoir.

The packer initially deflates because of the pressure differential across it. The pressure of the mud on top of the packer is likely to be greater than the pressure of the formation fluid below the packer. Therefore, the mud exerts a squeezing pressure on the packer. Furthermore, when the seal against the borehole wall is broken, the fluid rushing past the packer will assist in deflating the packer. Furtherstill, the drill stem 17A is lowered in the borehole. This causes the lower collar to telescope back inside of the upper collar (the drill bit bottoms in the borehole). During this telescoping, the upper collar squeezes the packer as it is lowered down over the packer.

Several things occur as the lower collar telescopes back into the upper collar. At the lower end of the lower collar, the upper head 275 moves closer to the flange 235 (FIG. 19B), while the lower head 277 slides down the lower collar. In the middle of the lower collar, the reservoir 265 enlarges by virtue of the piston 239 being pulled away from the flange 235 by the lower collar. Enlarging the reservoir enables fluid from the bladder to more easily escape the packer. At the upper end of the lower collar, the dogs 247 reseat in the channel 225. The nipple 23A is urged back into contact with the dog flanges 249 by the spring 255. The lower collar is now locked to the upper collar.

As the packer deflates, drilling mud is reverse circulated. The drilling mud pushes formation fluids up the drill stem to the surface. During the reverse circulation, the liquid or gas in the drill stem can be vented in a controlled manner.

The formation fluids may contain oil, gas, salt water, and drilling mud. Failing to control the drilling fluids at the drilling rig can result in a blowout, fire, or other hazard. The present invention provides for the controlled removal of formation fluids at the drilling rig. The formation fluids can be routed to a protected area, such as a tank, pit, etc. When the drilling mud exiting through the drill stem is clean of formation fluid, then that is an indication that all of the formation fluids have been removed from the drill stem.

Drilling can then continue. If another drill stem test is desired, the testing tool is ready to operate. The tool need not be brought to the surface to make ready for a second test. It can remain downhole with the bit. When the bit is brought to the surface, the testing tool can be serviced.

Figure 22A:
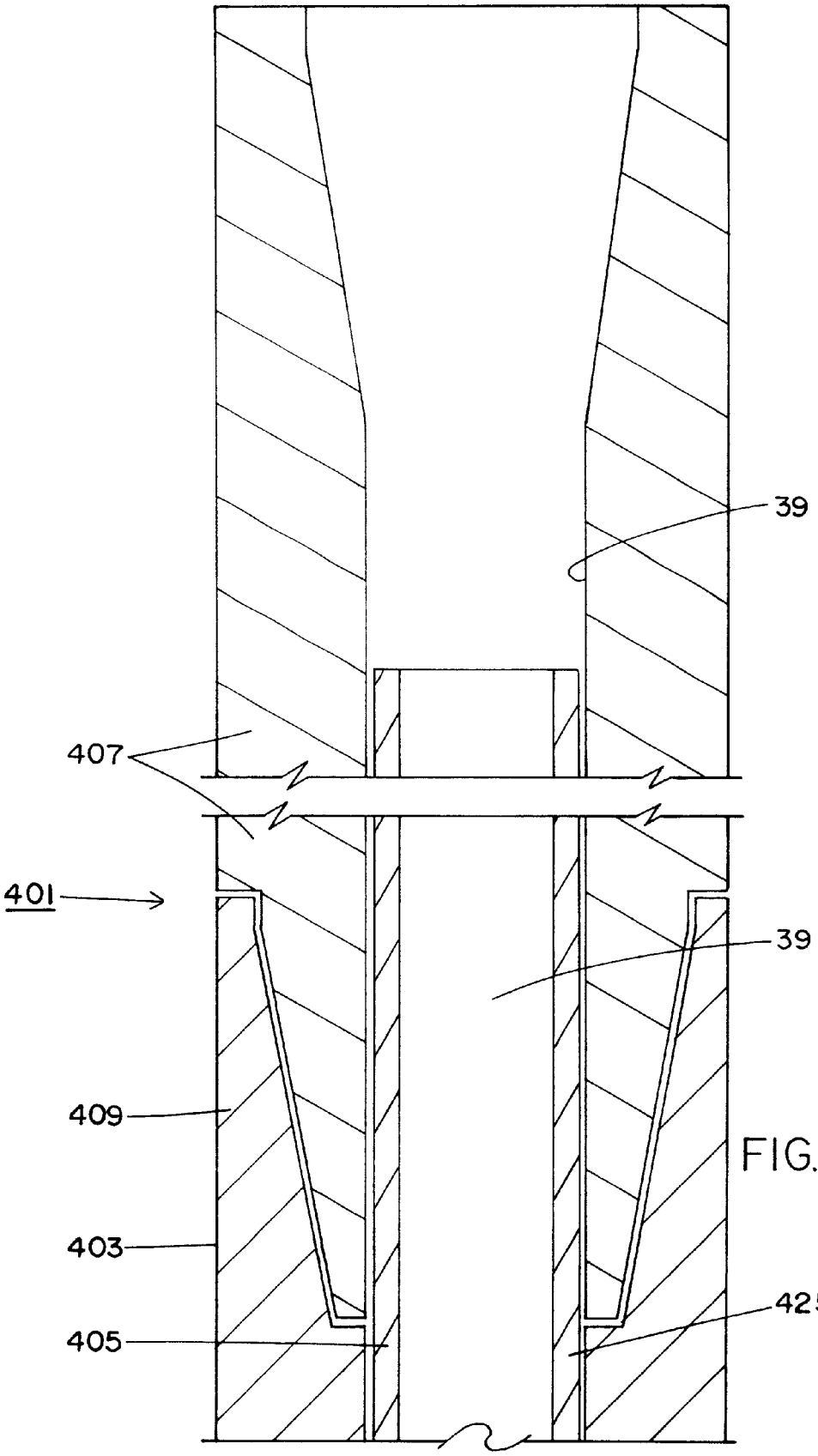
FIGS. 22A, 22B, 22C, 22D and 22E are longitudinal cross-sectional views of the testing tool in accordance with another embodiment.
Figure 22B:
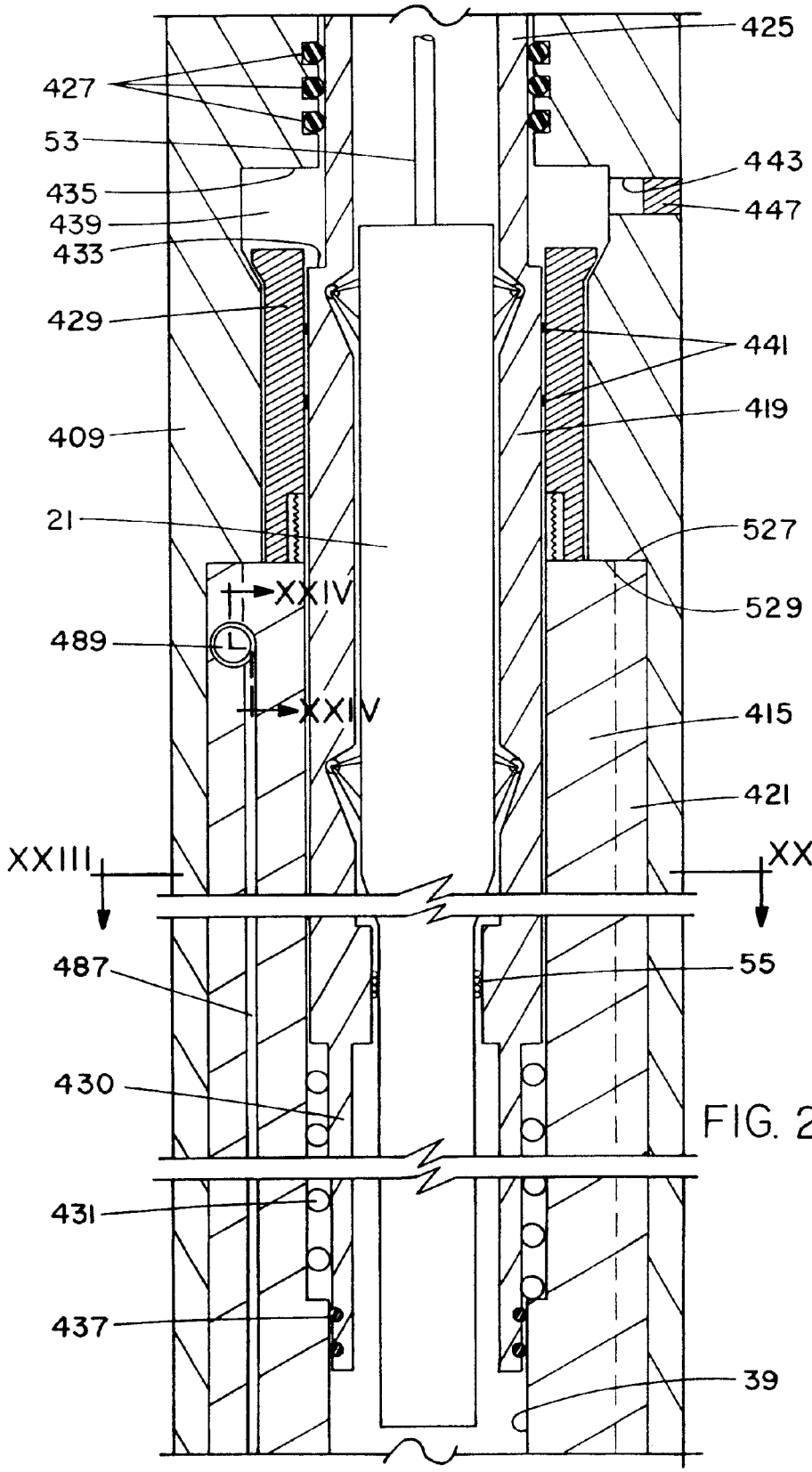
Figure 22C:
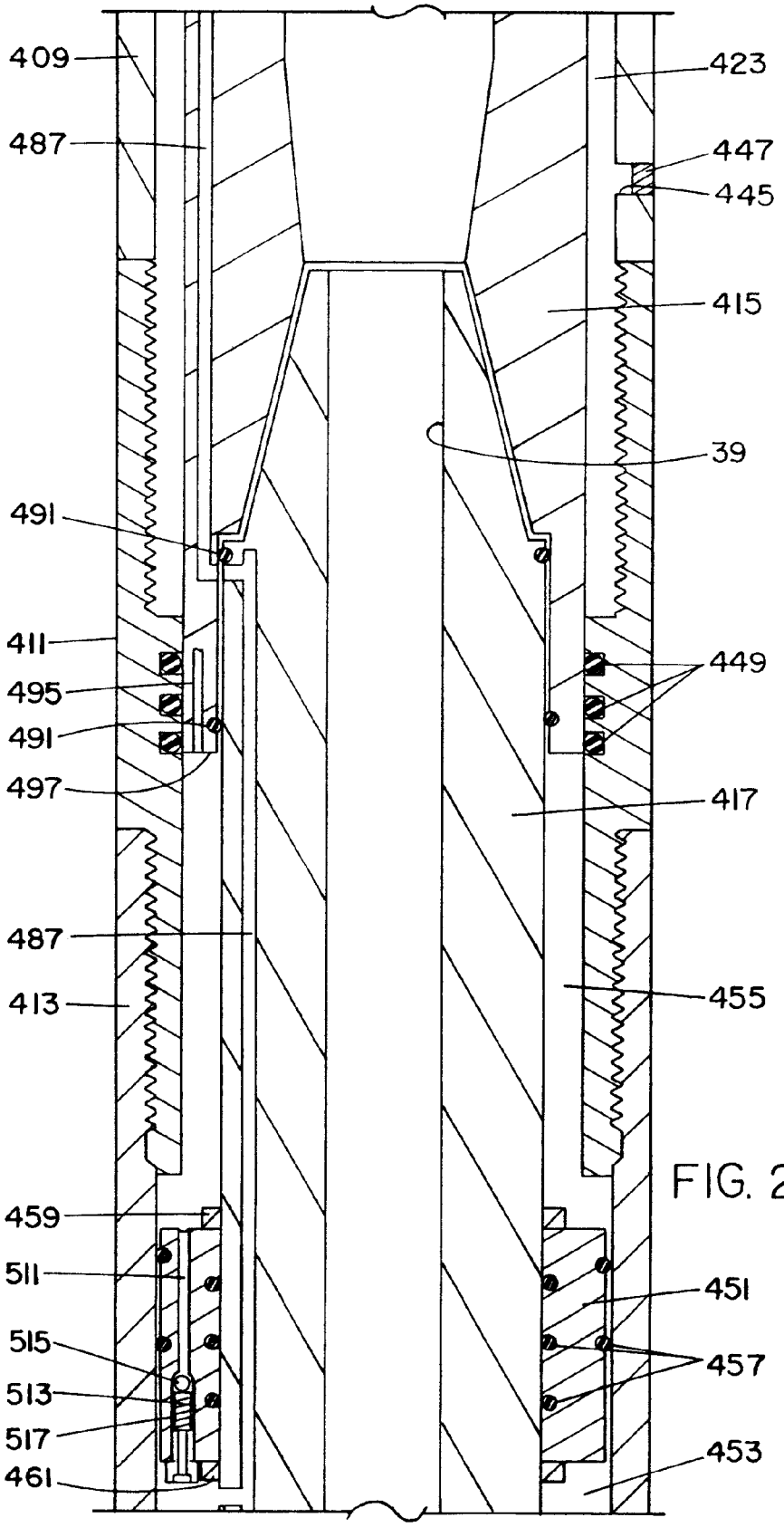
Figure 22D:
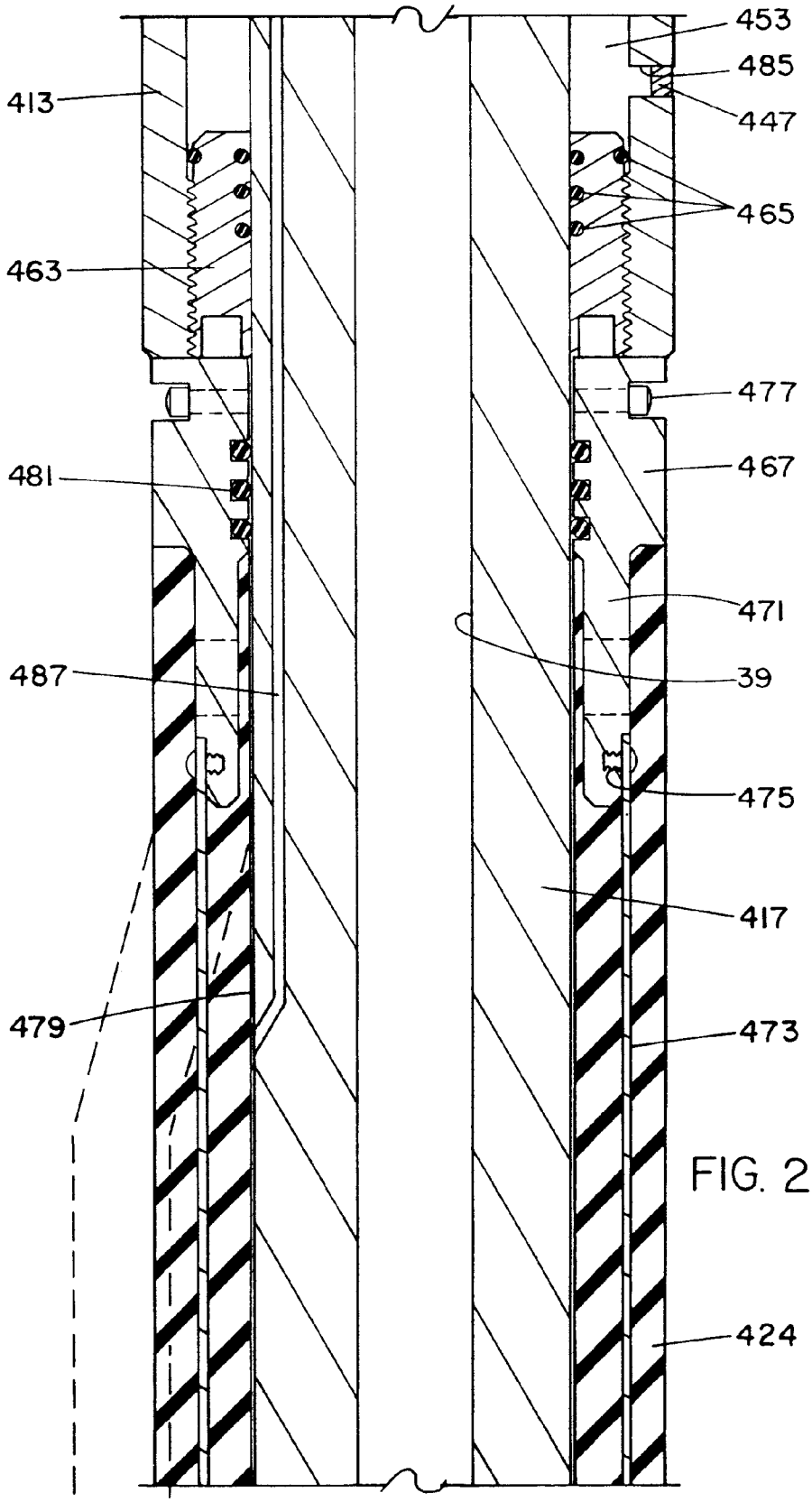

FIGS. 22A–22E show the testing tool 401 in accordance with another embodiment. The testing tool 401 is similar to the testing tool 201 described above. The testing tool 401 includes an outer assembly 403 and an inner assembly 405. The outer assembly 403 includes an upper collar receiving sub 407 (FIG. 22A), an upper collar 409 (FIGS. 22A, 22B, 22C), an upper baffle plate sub 411 (FIG. 22C), and an oil chamber housing 413 (FIGS. 22C, 22D). The outer assembly 403 forms a housing for the inner assembly 405.

In the description herein, terms such as "upper" and "lower" refer to the orientation of the tool inside of a vertical borehole.

When the tool is located in the borehole, the outer assembly parts are connected to the drill stem in descending order as follows: the upper collar receiving sub 407, the upper collar 409, the upper baffle plate sub 411 and the oil chamber housing 413. The outer assembly 403 is connected to the circulating sub 202, which in turn is connected to the lowermost drill collar 35. Connections between various components are by threaded couplings.

The testing tool 401 can be used without a circulating sub. In that situation, the upper end of the upper collar receiving sub is connected at the lowermost drill collar.

The inner assembly 405 includes a lower collar 415 (FIGS. 22B, 22C), a packer mandrel 417 (FIGS. 22C, 22D, 22E) and a nipple 419 (FIGS. 22A, 22B). The lower collar 415 and the packer mandrel 417 are connected together so as to move together. The lower collar and the packer mandrel are longitudinally slidable within the outer assembly 403. However, the lower collar and the packer mandrel rotate in unison with the outer assembly 403. This is because the lower collar 415 has splines 421 (see FIG. 23) that are received by grooves 423 inside of the upper collar 409. The upper collar has splines 507 that are received by corresponding grooves in the lower collar. Although not shown in FIG. 23, there are gaps between the splines 421, 507.

The testing tool can also be used with a bit sub. The lower end of the packer mandrel is connected to the bit sub. The bit sub can be a float sub 209.

The packer mandrel 417 contains a packer 424. The packer 424 is located below the oil chamber housing 413 (see FIGS. 22D and 22E). In the embodiment shown in FIGS. 22A through 22E, there is no sheathing around the uninflated packer 424. The packer is constantly exposed to the borehole.

The nipple 419 is longitudinally slidable within the lower collar 415. The nipple 419 is substantially similar to the nipple 23 of FIG. 2, wherein the data probe 21 can seat and latch therein. The nipple 419 has an upper sleeve 425 that extends up into the upper end of the upper collar 409 (see FIGS. 22A, 22B). Seals 427 are provided between the upper sleeve 425 and the upper collar 409 at a location that is above the dogs 429. The nipple 419 also has a lower sleeve 430 that extends down past the spring 431 (see FIG. 22B). The spring 431 pushes the nipple up. Upward travel of the nipple inside of the upper collar is limited by stop surfaces 433, 435. Seals 437 are provided between the nipple lower sleeve 430 and the lower collar 415 at a location that is below the spring 431. The seals 427, 437 keep debris out of the dogs 429, the annular space between the nipple and the lower collar, and the spring 431, wherein the nipple can slide easily with respect to the upper and lower collars. In addition, the seal 437 and the data probe seals 55 aid in shutting in the borehole.

The dogs 429 serve to releaseably latch the lower collar 425 to the upper collar 409. The lower end of the dogs 429 are coupled to the lower collar. The dogs 429 are substantially similar to the dogs 247 of FIG. 19B.

There is a cavity 439 between the dogs 429 and the upper collar 409. This cavity 439 is used in a test for component part wear, which test will be described in more detail hereinbelow.

Small lobes 441 are located between the dogs 429 and the outside diameter of the nipple 419. The lobes 441 reduce the surface contact between the dogs and the nipple. The upper sleeve 425 of the nipple 419 has a reduced outside diameter from the nipple itself. Thus, as the nipple travels down inside of the testing tool, the dogs 429 can be forced into this reduced diameter, thereby allowing the lower collar to move relative to the upper collar. The splines 421 on the lower collar 415 do not extend the full length of the upper collar grooves 423. Thus, as the lower collar descends inside of the upper collar, the splines can freely slide down inside of the grooves 423.

The upper collar 409 has upper and lower ports 443, 445 that allow communication between the exterior and the interior of the upper collar (see FIGS. 22B, 22C). The ports are sealed by respective plugs 447. The lower port 445 is located near the lower end of the upper collar (see FIG. 22C). The upper port 443 is located just below the seals 427 (see FIG. 22B). Each plug 447 provides a seal. Seals 449 (see FIG. 22C) are located between the upper baffle plate sub 411 and the lower collar 415. The spaces formed by the seals 427, 437 and 449 are filled with gear oil. In addition, a seal can be provided between the coupling of the upper collar 409 and the lower baffle plate sub 411.

The packer mandrel 417 depends from the lower collar 415 (see FIG. 22C). The inside passage 39 extends through the upper collar receiving sub 407 (FIG. 22A), the nipple 419, the lower collar 415 and the packer mandrel 417. An annular cavity (FIGS. 22C, 22D) is formed between the packer mandrel 417 and portions of the outer assembly, namely the upper baffle plate sub 411 and the oil chamber housing 413. The cavity is divided by a piston 451 into an oil chamber 453 (located below the piston) and a dump chamber 455 (located above the piston).

The piston 451 is annular, fitting inside of the annular cavity. Seals 457 are provided between the piston 451 and the packer mandrel 417 and between the piston 451 and the oil chamber housing 413. The piston 451 is coupled to the packer mandrel 417 by a piston lock ring 459 and a snap ring 461. Thus, the piston 451 moves longitudinally up and down in unison with the packer mandrel 417.

The bottom of the oil chamber 453 is closed by a lower baffle plate 463 (see FIG. 22D). The lower baffle plate 463 is also annular and is located between the packer mandrel 417 and the oil chamber housing 413. Seals 465 are provided between the lower baffle plate 463 and the packer mandrel 417 and between the lower baffle plate 463 and the oil chamber housing 413. The lower baffle plate 463 is coupled to the oil chamber housing 413. Thus, the packer mandrel 417 slides through the lower baffle plate 463.

Upper and lower ports are provided for the oil chamber 453. (Only the lower port 485 is shown in the drawings (see FIG. 22D).) The ports are sealed by respective plugs 447. The lower port 485 is located near the lower baffle plate 467 while the upper port is just below the piston 451 when the piston is at its topmost position.

Located below the lower baffle plate 465 and around the packer mandrel are the upper and lower packer heads 467, 469 (see FIGS. 22D and 22E). The upper and lower packer heads are annular in shape. The upper and lower packer heads each have a flange 471 that extends longitudinally and also circumferentially around the packer mandrel. The flange 471 of the upper packer head 467 extends toward the lower packer head 469, while the flange of the lower packer head extends toward the upper packer head. The flanges are annular and are spaced from the packer mandrel by a gap.

The packer 424, or bladder, is a sheath of elastomeric material that extends between the upper and lower packer heads 467, 469. The packer is formed of sheets wrapped around the mandrel. The upper and lower ends of the packer 424 are coupled to the upper and lower packer heads 467, 469 respectively.

A number of spring steel straps 473 are embedded inside of the packer material. The straps extend between the upper and lower packer heads 467, 469, to which they are secured by screws 475. The straps are spaced around the circumference of the packer mandrel. In the preferred embodiment, six straps are used.

The upper packer head 467 is secured onto the packer mandrel 417 by set screws 477 just below the lower baffle plate 463. Thus, the upper packer head 467 moves in unison with the packer mandrel 417. The lower packer head 469 can slide along the packer mandrel 417.

The outside diameter of the uninflated packer 424 is slightly less than the outside diameter of the outer assembly 403. This protects the packer somewhat from excessive wear against the borehole wall.

Figure 22E:
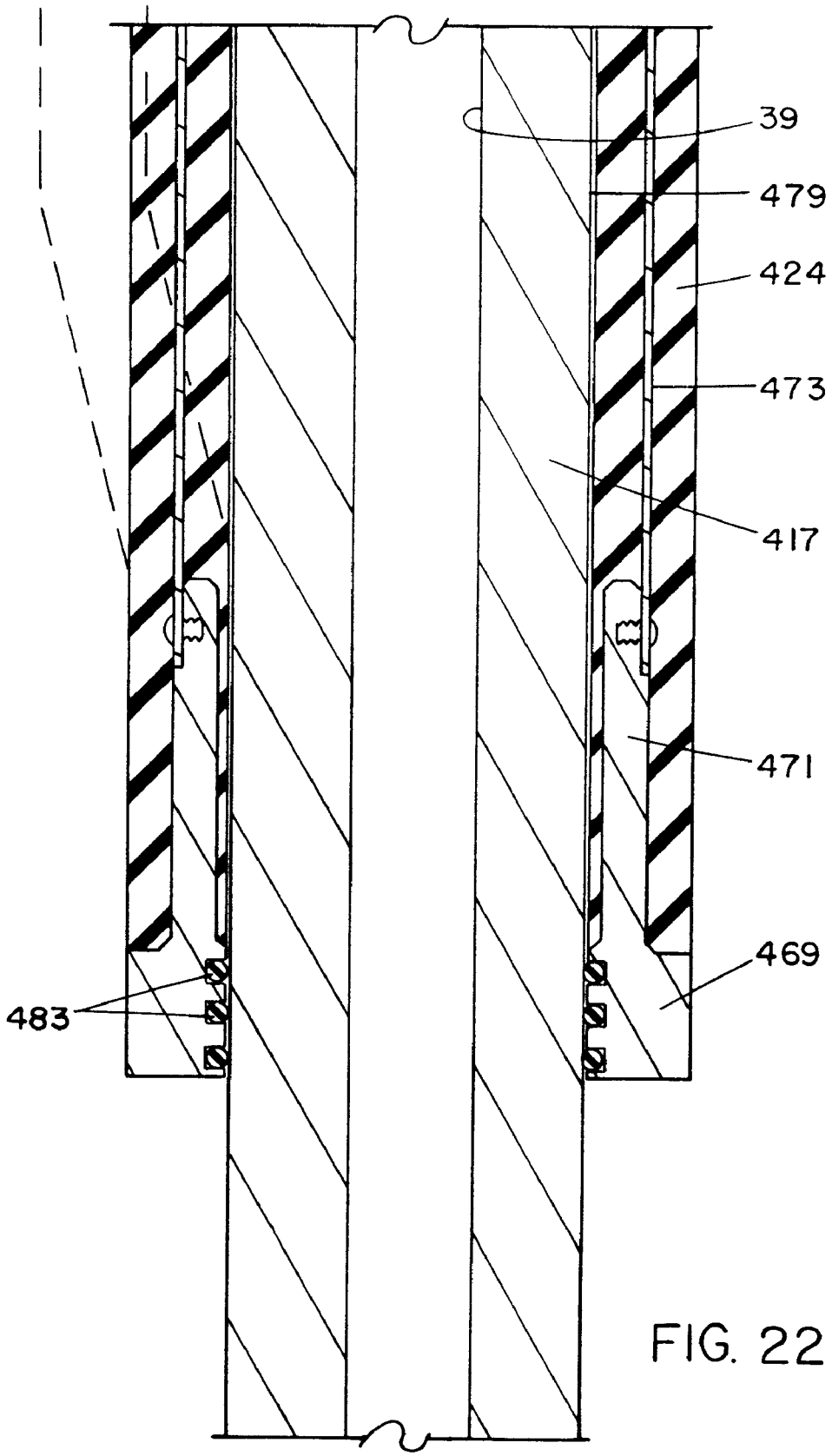
Figure 23:
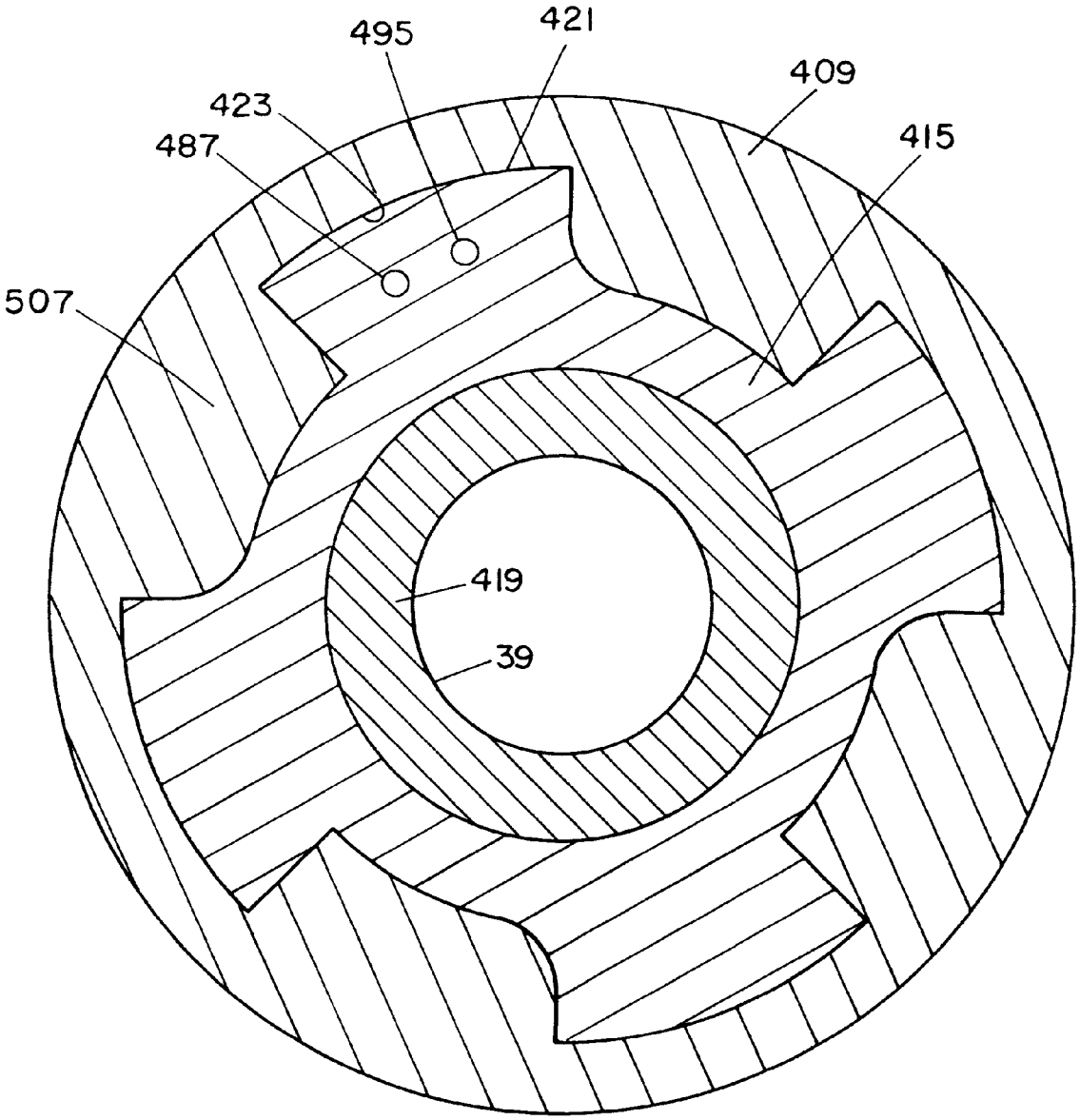
FIG. 23 is a transverse cross-sectional view of the splines, taken through lines XXIII—XXIII of FIG. 22B.

A chamber 479 separates the packer 424 from the packer mandrel 417 (see FIGS. 22D and 22E). The chamber 479 is sealed at the top by seals 481 between the upper packer head 467 and the packer mandrel 417, and at the bottom by seals 483 between the lower packer head 469 and the packer mandrel 417.

The chamber 479 communicates with the oil chamber 453 by a first passage 487 (see FIGS. 22C, 22D). The first passage 487 extends from the oil chamber 453 down through the packer mandrel 417 to the chamber 479. In the preferred embodiment, the first passage 487 is drilled in a wall of the packer mandrel 417. The first passage 487 also extends upwardly from the oil chamber 453 to a bypass valve 489 located in a spline in the lower collar 415 (see FIG. 22B). The first passage 487 extends through the coupling of the packer mandrel 417 and the lower collar 415 (see FIG. 22C). This junction is sealed by upper and lower seals 491.

Figure 24:
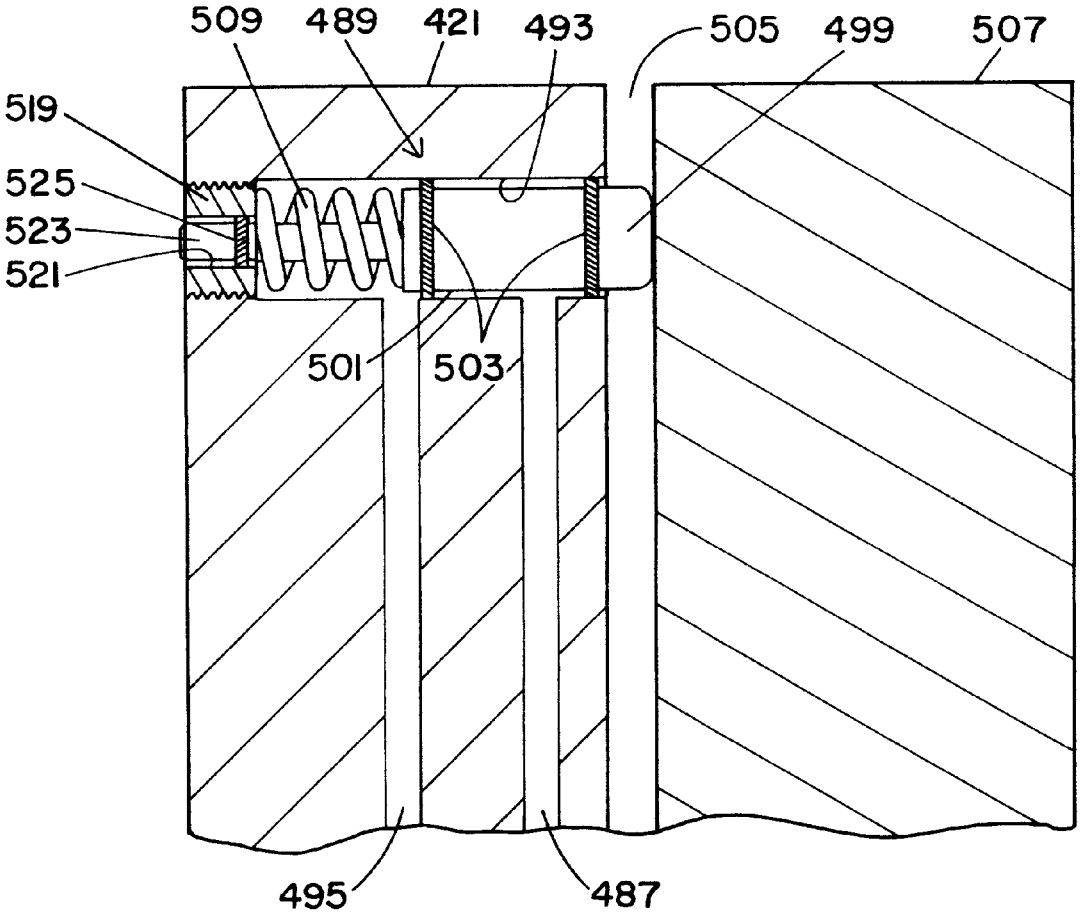
FIG. 24 cross-sectional view taken through lines XXIV—XXIV of FIG. 22B showing the bypass valve.

The bypass valve 489 is as shown in FIG. 24. A cylindrical bore 493 is formed in a spline 421 of the lower collar 415. The bore is circumferentially oriented in the spline. The bore 493 is intersected by the first passage 487 that communicates with the oil chamber. The bore 493 is also intersected by a return passage 495. The return passage 495 is separate from the first passage 487. The return passage 495 extends from the bore 493, inside of the lower collar 415 down to the lower end 497 of the lower collar 415, where the return passage communicates with the dump chamber 455 above the piston 451 (see FIG. 22C).

A cylinder 499 (see FIG. 24) is located inside of the bore 493. There is a gap 501 between the cylinder 499 and the bore 493. The cylinder 499 has two spaced apart o-rings 503 thereon. When the valve 489 is closed, as shown in FIG. 24, communication between the two passages 487, 495 is prevented by one of the o-rings 503 and the cylinder 499 extends out of the spline into a gap 505 between the lower collar spline 421 and the adjacent upper collar spline 507. When the upper collar 409 is rotated, the cylinder 499 is pushed inside of the bore 493 and the valve 489 opens. Communication is thus established between the two passages 487, 495. The valve 489 is kept normally closed by a spring 509 that extends between the cylinder 499 and a plug 519. The plug has a center aperture 521, which aperture receives a stem 523. The stem 523 is connected to the cylinder 499. An o-ring 525 forms a seal between the stem 523 and the aperture 521.

The return passage 495 allows oil to flow to the dump chamber 455 above the piston (see FIG. 22C). The oil is returned to the oil chamber 453 by a passage 511 extending through the piston 451. The passage 511 has a one way valve 513 therein. Fluid can flow from the dump chamber 455 into the oil chamber 453 but not from the oil chamber into the dump chamber. The one way valve 513 has a ball 515 and a spring 517 that pushes the ball valve closed.

The operation of the testing tool 401 is similar to the testing tool 201 described above. It is used in conjunction with the data probe 21.

During drilling, mud flows through the inside passage 39 down to the drill bit. Rotary force is transmitted from the drill pipe and drill collars, through the tool to the drill bit. Specifically, the drill pipe and drill collars rotate the outer assembly 403, which functions as an extension of the drill pipe and drill collars. The upper collar 409 rotates the lower collar 415 via the splines 421, 507. The lower collar transmits this rotational force to the packer mandrel and on to the drill bit. In addition, weight is transferred from the upper collar to the lower collar by bearing surfaces 527, 529 (see FIG. 22B). The upper collar surface 529 bears on the top surface 527 of the lower collar splines. Thus, weight can be applied from the surface along the drill stem to the bit during drilling.

To conduct a drill stem test, the inside of the drill string is cleared of mud using compressed gas. Then, the data probe 21 is dropped down inside of the drill string. It seats and latches inside of the nipple 419. This seals the inside of the drill string.

To inflate the packer 424, the pressure of the compressed gas is increased inside of the drill stein. This exerts a downward pressure on the data probe 21. The data probe 21 and the nipple 419 are pushed down inside of the lower collar 415. The spring 431 is compressed by the moving nipple. The lobes 437 reduce the friction between the dogs 429 and the nipple 419. The lower end of the dogs 429 are coupled to the lower collar 415. The dogs 429 are freed by allowing their upper ends to move radially inward toward the upper sleeve 425. When the dogs 429 move in, the lower collar 415 is free to slide down inside of the upper collar 409.

The testing tool is designed to prevent accidental deployment. The dogs call only be freed from the inside of the drill stem. Thus, if the testing tool contacts a bridge when being pulled up out of the borehole, the packer will not inflate. Likewise, increased pressure, by itself, is insufficient to actuate the testing tool. For example, if the jets inside of the drill bit become plugged, and the pressure inside of the drill stem increases as a consequence, the testing tool will not actuate and the packer will not inflate.

The weight of the entire lower assembly (the inner assembly 405 and the weight supported by the inner assembly) pulls the lower collar 415 down. This in turn moves the piston 451 (see FIG. 22C) down inside of the oil chamber 453. Oil is forced into the packer chamber 479 (see FIG. 22D) via the first passage 487, wherein the packer 424 expands (as shown by dashed lines in FIGS. 22D and 22E). Compressed gas in the drill stem can be used to speed up the inflation of the packer. The lower packer head 469 slides up along the packer mandrel 417 as the packer expands. The straps 473 inside of the packer protect the packer from overinflating. The expanded packer seals off the annulus.

The well is now shut in.

The oil chamber 453 contains about twice as much oil as is needed to expand the packer for a typical borehole. However, some boreholes may be larger than intended because of washing. Because of this excess oil capacity, the packer is able to expand sufficiently far to seal against such enlarged boreholes. The oil chamber can be large enough to accommodate several packers.

As the piston 451 moves down, the volume of the dump chamber 455 increases due to the inside diameter of the oil chamber housing 413 being larger than the inside diameter of the upper baffle plate sub 411.

The packer 424 remains inflated due to the weight of the inner assembly 405 (the lower collar and the packer mandrel) and all of the components that pull down on the packer mandrel (such as the drill bit). If the borehole is deep, then subs can be added between the packer mandrel and the drill bit to increase the weight pulling down on the inner assembly 405.

Alternatively, a ratchet can be used between the upper and lower collar. The ratchet allows the lower collar to move down, but resists upward movement. The ratchet can be a pin that protrudes from the lower collar into one of a series of longitudinally spaced cavities in the upper collar. The ratchet is retracted by a hydraulic valve, which valve is opened by rotating the drill stem, much like the bypass valve 489.

This ratchet mechanism can also be used on the testing tool 201 of FIGS. 19A–19C.

After the initial shut in and flow periods, the data probe 21 can be released and retrieved by manipulating the wireline 53. The wireline is picked up to open the bypass inside of the data probe 21. Pressure equalizes above and below the data probe. The wireline is picked up again to release the data probe from the nipple and to retrieve the data probe to the surface. A compressed gas cushion can be maintained inside of the drill stem on the formation during the retrieval of the data probe.

The data probe is used to shut in the well. Releasing the data probe allows the well to produce into the drill stem.

When the drill stem test is finished, the testing tool is disengaged from the borehole wall by deflating the packer 424. To deflate the packer, the drill stem is rotated slightly, wherein the valve 489 is opened (see FIG. 24). Specifically, the cylinder 499 is pushed inwardly by the upper collar spline 507 and communication is established between the first passage 487 and the return passage 495. The o-rings 503, 525 prevent leakage of the oil outside of the valve. The inflated packer forces oil through the first passage 487, around the cylinder 499, through the return passage 495, and into the dump chamber 455 above the piston 451. The packer is thus allowed to deflate. The straps 473 inside of the packer aid in pulling the packer back to the fully deflated position, and pushes the lower packer head 469 back down the packer mandrel 417. Lowering the upper collar or putting weight on the bit returns the piston 451 to its original position. This forces the packer mandrel 417, the lower collar 415 and the piston 451 up. Oil flows from the dump chamber 455 into the oil chamber 453 through the one way valve 513.

The testing tool 401 is now reset for drilling or other activity. The testing tool can be reused downhole, without the need of being brought back up to the surface for refit. Thus, drilling can continue with the drill stem being left in the borehole. If another drill stem test is to be made, the testing tool is ready for use.

When the drill stem is retrieved to the surface, the testing tool can be checked over to determine if any repairs are needed before it is sent back downhole. For these checks, the testing tool 401 is kept in a vertical orientation.

An operator checks the oil in the oil chamber 453. The upper and lower ports 485 are opened by removing the plugs 447 to access the oil chamber. Oil is pumped into the oil chamber via the lower port 445. The operator observes the oil flowing out of the upper port 443. The operator is looking for air or mud in the oil discharge. The presence of either air, or mud, or both, would indicate a damaged seal around the oil chamber 453. If the oil flowing out of the oil chamber is clean, then the oil chamber is fine and the plugs 447 are replaced.

The operator also checks the oil in the splines 421, 507. The upper and lower ports 443, 445 are opened by removing the plugs 447 and the oil is checked using the same procedure as discussed above with respect to the oil chamber.

The operator checks the wear points inside of the testing tool. One area of wear is at the top surface 527 of the lower collar splines (see FIG. 22B) and the bearing surface 529, where the upper collar bears down on the lower collar. To check for wear on these surfaces, the testing tool is kept vertical, with the bottom end of the packer mandrel 417 bearing on a surface such as the rig floor. The upper collar is allowed to slide down. The upper collar has a shoulder surface 529 that bears on the top surface 527 of the lower collar splines. If there is any wear on these two surfaces, then the upper collar will move down relative to the lower collar. The upper collar can move down because of the gap 439 above the dogs. Any wear on these surfaces 527, 529 is indicated by relative movement of the packer mandrel 417 and the lower baffle plate 463. A gap can be left between the lower baffle plate 463 and the upper packer head so as to expose a portion of the packer mandrel 417 to view. Markings on the packer mandrel indicate the amount of travel of the packer mandrel in and out of the lower baffle plate.

Another area of wear is between the upper and lower collar splines 421, 507. Such wear can be measured by rotating the lower collar relative to the upper collar. Markings on the oil chamber housing 413 and the upper packer head 467 provided an indication of the amount of wear.

All of these checks can be performed at the well site, and even on the drilling rig floor. These checks can be made without disassembling the testing tool, thus speeding up turn around time. Furthermore, any repairs that must be performed can be accomplished at the well site and even on the rig floor. If the upper and lower collars have experienced excessive wear, these component parts can be easily and relatively inexpensively replaced.

The operational life of the testing tool can be increased by using tungsten steel at the wear areas.

The testing tools 201, 401 have been described in conjunction with a drill stem test. However, the testing tools can be used in other applications. In the discussion that follows, reference will be made to the tool 401, although the tool 201 could also be used.

One such application is as a downhole blowout controller. The testing tool is configured in the drilling stem for drilling, as discussed above. If the well begins to blow out, the testing tool is set to seal both the annulus and the drill stem inside passage.

The testing tool is used in conjunction with a circulating sub 202 shown in FIG. 26. The sub 202 has a housing 541. The housing 541 has upper and lower ends 543, 545 and an inside passage 39 therethrough. The upper end 543 is connected to the bottommost drill collar. The lower end 545 is connected to the top of the testing collar 401. The inside passage 39 has an upwardly facing shoulder 547. Above the shoulder 547 is a port 549 that allows communication between the inside passage 39 and the exterior of the housing 541.

A cylindrical sleeve 551 is located inside of the inside passage 39. The sleeve 551 has first and second portions 553, 555. The first portion 553 is of a larger outside diameter than is the second portion 555, with a shoulder 557 separating the two portions. The shoulder 557 is located above the housing shoulder 547. A coil spring 559 is located around the second portion 555 and extends between the two shoulders 547, 557. At the upper end of the first portion 553 are apertures 561 through the sleeve 551.

Seals 563 are provided between the sleeve first portion 553 and the housing 541. The seals 563 are positioned between the apertures 561 and the port 549 when the sleeve 551 is in the closed position. Seals 565 are also provided between the sleeve second portion 555 and the housing 541 below the shoulder 547.

The port 549 is provided with a one way valve 567, to allow flow from the inside passage 39 to the annulus around the circulating sub 202. The valve 567 has a ball that contacts a seat. A spring biases the ball closed. The spring acts against a perforated plug.

The sleeve 551 moves between open and closed positions, with FIG. 26 showing the sleeve in the closed position. With the sleeve in its closed position, the apertures 561 are located above the port 549. Fluid in the inside passage 39 is prevented from flowing into the port 549. When the sleeve is pushed down, it is in the open position and fluid can flow from the inside passage to the port, and through the port to the annulus outside. The one-way valve 567 prevents fluid in the annulus from flowing through the port into the inside passage.

The circulating sub 202 is located above the testing tool 201, 401 (see FIGS. 13–18).

Dead men are used to actuate the testing tool and the circulating sub. In FIG. 25 is a typical dead man.

The dead man 577 shown in FIG. 25 is a cylindrical bar of metal, having upper and lower ends 579, 581. Near its bottom end 581 is an assembly of seals and spacers. Beginning at the bottom end and moving up, there is a jam nut 583, packing 585, a spacer 587, more packing 589, another spacer 591 and a no go 593. The jam nut and the no go hold the packings and the spacers in place along the length of the dead man. At the upper end of the dead man is a fishing neck.

There are two dead men used to actuate the circulating sub and the testing tool. The two are substantially similar to one another except that the circulating sub dead man is of a larger outside diameter than the testing tool dead man and the circulating sub dead man has jars and a fishing tool at its lower end.

During a blow out, the testing tool dead man is dropped first down the drill stem.

The dead man 577 is dropped down the inside passage 39 of the drill stem during a blow out. No wireline is used; the dead man is allowed to free fall. In addition, the pump is operated to pump mud down on top of the dead man. The dead man 577 seats in the nipple 419 and seals the inside passage of the drill stem. The pump pressure actuates the nipple, which in turn releases the lower collar from the upper collar and the packer inflates. The well is now shut in and the blow out is controlled. Continued pump pressure on the dead man is maintained.

The circulating sub 202 is opened after the well is shut in to allow circulation of mud into the annulus. The circulating sub is opened by dropping in the circulating sub dead man 569 down the drill stem. The dead man is received by the sleeve 551, wherein the sleeve second portion 555 is sealed by the packing on the dead man. Pump pressure forces the sleeve 551 down, and drops the apertures 561 below the seals 563. Mud flows from the drill stem out into the annulus. The weight of the mud is increased in order to control the blow out.

The length of the dead man 569 in the circulating sub 202 is sufficient so that the lower end 575 of the dead man 569 latches onto the upper end of the lower dead man 577.

When the mud is properly weighted and the borehole is ready, the dead men 569, 577 are released. The dead men are released by dropping in a fishing tool with jars. The fishing tool, which is on a wireline, has catch dogs on its lower end. The fishing tool catches onto the fishing neck 573 to latch on to the upper dead man 569. Then, the fishing tool is picked up by the wireline, wherein the dead men 569, 577 are picked up from the nipple. This opens the inside passage of the drill stem. Rotating the drill stem deflates the bladder to open the annulus. Borehole operations can continue, with the blow out controlled by the mud weight.

If control of the blow out is lost, then the tools are retrieved, to be dropped in sequence again. The mud weight can be adjusted again.

Still another application for the testing tool involves controlling lost circulation. This occurs when the drilling mud is lost into a formation. The testing tool is picked up to a location above the formation. A dead man 577 is used to actuate the testing tool as described above, in order to shut in the well. With the well shut in, the circulating sub above the testing tool is opened. Drilling mud of a lower weight treated with loss circulation material (peanut shells, cotton seed hulls, cedar fiber, paper material, etc.) is circulated into the annulus. When the borehole is ready, the well is opened up by closing the circulating sub and removing the dead man.

As an alternative to the dead man 577, the data probe 21 can be used to shut in the well during a blow out or a thief zone.

For deep wells, additional packers can be used. For example, two bladders can be used, namely an upper packer and a lower packer.

Although the seals of the testing tool have been described and shown as o-rings, other types of seals can be used. For example, metal rings can be utilized.

The foregoing disclosure and the showings made in the drawings are merely illustrative of the principles of this invention and are not to be interpreted in a limiting sense.

What is claimed is:

1. A method of conducting a drill stem test in a borehole, the drill stem having a drill bit, comprising the steps of:

a) drilling with the drill stem in the borehole by rotating the drill stem, applying weight to the drill stem from the surface, and pumping drilling fluids down through the drill stem;

b) ceasing rotation of the drill stem and the drill bit;

c) maintaining the drill stem in the borehole;

d) lowering a valve member from the surface inside of the drill stem, allowing the valve member to latch and seat in a valve seat so as to close off the drill stem and initiate the inflation of a packer, allowing the valve member to unlatch a piston in a fluid reservoir isolated from drilling fluid to the borehole; and e) forcing the piston to compress the fluid reservoir thereby inflating said packer with fluid from the fluid reservoir.

2. The method of claim 1, further comprising the step of opening the valve formed by the valve member in the valve seat so as to allow a formation to produce into the drill stem, while maintaining the packer in an inflated condition.

3. The method of claim 2 wherein the step of opening the valve formed by the valve member and the valve seat further comprises the step of opening a passage through the valve member.

4. The method of claim 3 wherein the step of opening a passage through the valve member further comprises the step of manipulating the valve member by a wireline so as to open the passage.

5. The method of claim 3, further comprising the step of:

a) providing the valve member with instrumentation;

b) the step of dropping a valve from the surface inside of the drill stem further comprises the step of dropping the valve member on a wireline;

c) after latching the valve member to the valve seat, manipulating the wireline to unlatch the valve member from the valve seat and retrieving the valve member to the surface, while maintaining the packer in the inflated condition.

6. The method of claim 1 further comprising the step of rotating the drill stem to open a bypass valve and allowing the fluid in the inflated packer to flow to a dump chamber, wherein the packer deflates.

7. The method of claim 6, further comprising the steps of:

a) applying additional weight on the drill bit after the packer has deflated and forcing the fluid in the dump chamber into the fluid chamber;

b) resuming drilling with the drill stem in the borehole.

8. The method of claim 1 further comprising the step of purging the drill stem after the step of ceasing rotation of the drill stem and the drill bit.

9. The method of claim 1 further comprising the step of picking up the drill stem a determined distance while maintaining substantially the entire drill stem in the borehole.

* * * * *